US010669688B2

(12) United States Patent
Surges

(10) Patent No.: US 10,669,688 B2
(45) Date of Patent: Jun. 2, 2020

(54) BASE PAD FOR PIER SUPPORT

(71) Applicant: PIER OF D' NORT CORP., St. Germain, WI (US)

(72) Inventor: Carl Surges, St. Germain, WI (US)

(73) Assignee: PIER OF D' NORT CORP., St. Germain, WI (US)

( * ) Notice: Subject to any disclaimer, the term of this patent is extended or adjusted under 35 U.S.C. 154(b) by 0 days.

(21) Appl. No.: 16/263,919

(22) Filed: Jan. 31, 2019

(65) Prior Publication Data

US 2019/0234040 A1 Aug. 1, 2019

Related U.S. Application Data

(60) Provisional application No. 62/625,201, filed on Feb. 1, 2018.

(51) Int. Cl.

| | |
|---|---|
| ***E02D 27/52*** | (2006.01) |
| *E04B 5/02* | (2006.01) |
| *E02D 27/34* | (2006.01) |
| *E04F 15/02* | (2006.01) |

(52) U.S. Cl.

CPC ..... *E02D 27/52* (2013.01); *E02D 27/34* (2013.01); *E04B 5/02* (2013.01); *E04F 15/02183* (2013.01); *E04F 2015/02061* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,933,380 A * | 1/1976 | Wellekens | ..... | E05B 55/12 292/175 |
| 4,220,421 A * | 9/1980 | Thorne | ..... | E02B 3/127 166/368 |
| 6,379,085 B1 * | 4/2002 | Vanderklaauw | ..... | B66F 1/00 405/230 |
| 7,241,078 B2 | 7/2007 | Surges | | |

* cited by examiner

*Primary Examiner* — Kyle Armstrong

(74) *Attorney, Agent, or Firm* — Merchant & Gould P.C.

(57) ABSTRACT

A base pad includes a main body that has a top side and a bottom side. The top side is configured to receive a pier support. The base pad includes a plurality of ribs positioned on the bottom side of the main body. The base pad includes at least one aperture that is defined by the main body. The aperture passes through the top side to the bottom side of the main body. The aperture is configured to receive a fastener for securing the pier support to the top side of the main body.

15 Claims, 22 Drawing Sheets

BASE PAD FOR PIER SUPPORT

CROSS REFERENCE TO RELATED APPLICATION

This application claims the benefit of U.S. Provisional Patent Application No. 62/625,201, filed Feb. 1, 2018, which application is hereby incorporated by reference in its entirety.

BACKGROUND

Piers (also known as docks) provide a platform that extends from land, over a body of water. Piers can either be floating structures or raised, supported platform over the water surface. These platforms can provide a convenient storage solution for small watercraft, a walkway over the water, or simply a raised dry surface.

To properly support the pier when the pier is not of the floating variety, a series of support legs rest on an underwater surface (i.e., lake bottom, river bottom, pond bottom, etc.). However, the support legs of a pier have a tendency to sink into, and shift around on, the underwater surface, thereby causing a multitude of potential problems. For example, as the support legs shift, the pier becomes unleveled. Further, such unleveling can cause damage to the pier itself. As the support legs sink into the underwater surface, removing the pier from the body of water becomes very difficult. This is even more problematic as the pier is often removed and installed in the body of water on a seasonal basis (e.g., removed during the winter, installed during the spring, summer, and fall). Thus, if the support legs are stuck in the underwater surface, removal becomes complicated and time consuming.

Therefore, improvements in pier design are needed.

SUMMARY

The present disclosure relates generally to a base pad for a pier. In one possible configuration, and by non-limiting example, a base pad arrangement includes a pair of fasteners and a base pad equipped with ribs on the bottom face and apertures for removal devices.

In one aspect of the present disclosure, a base pad for a pier support is disclosed. The base pad includes a main body that has a top side and a bottom side. The top side is configured to receive a pier support. The base pad includes a plurality of ribs positioned on the bottom side of the main body. The base pad includes at least one aperture that is defined by the main body. The aperture passes through the top side to the bottom side of the main body. The aperture is configured to receive a fastener for securing the pier support to the top side of the main body.

In another aspect of the present disclosure, a pier for use in a body of water is disclosed. The pier includes a main deck that includes a plurality of supports. Each support includes a foot and each foot includes a top side and a bottom side. The pier includes a plurality of base pads removably attached to the bottom side of each foot by at least one fastener. Each base pad has a surface area greater than a surface area of each foot. Each fastener interfaces with the top side of each foot to pin each foot to the base pad.

In another aspect of the present disclosure, a method of manipulating a pier is disclosed. The method includes providing a main deck having a plurality of supports. Each support has a foot and each foot includes a top side and a bottom side. The method includes attaching a base pad to at least one foot of the main deck with a quick-release fastener. The method includes positioning the base pad in contact with an underwater surface and removing the quick release fastener from above the water using a removal device.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
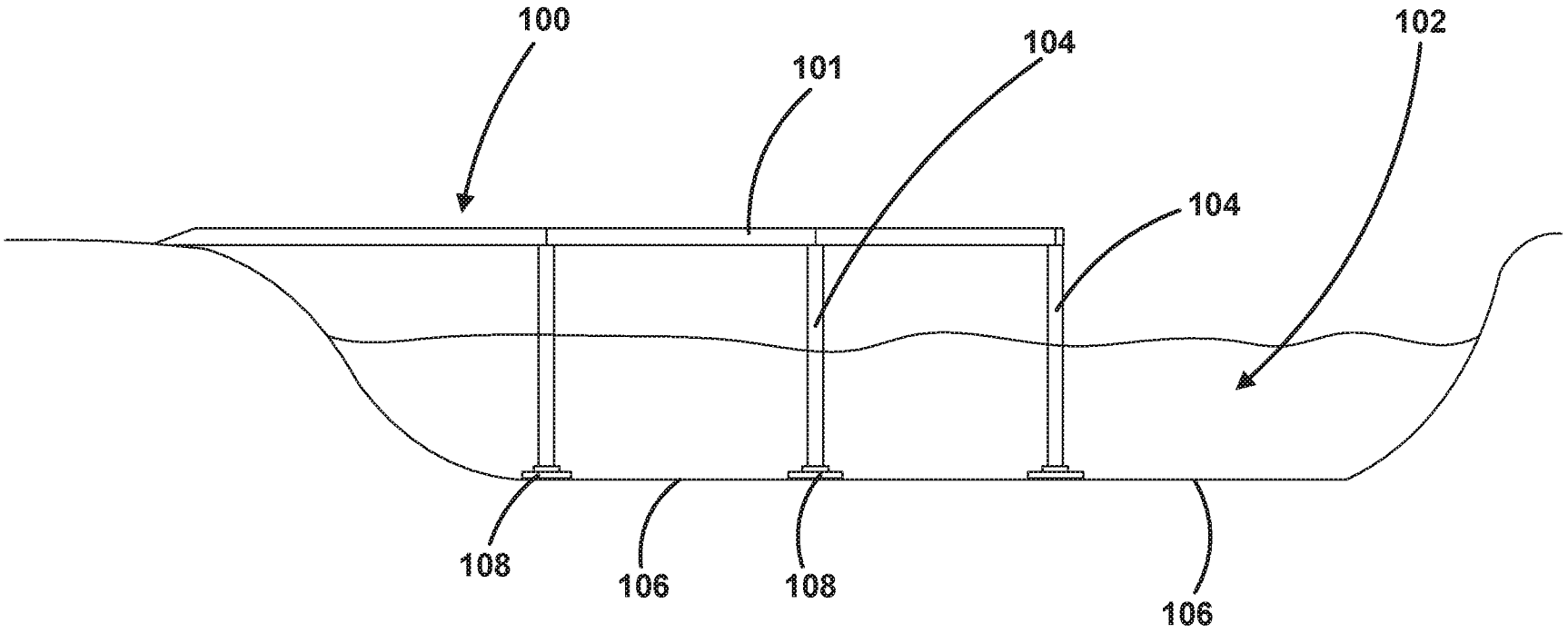
FIG. 1 illustrates a schematic view of a pier positioned in a body of water, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The base pad arrangement disclosed herein has several advantages. A plurality of base pads can be used with each pier. Each base pad is configured to be positioned on an underwater surface and stably support a pier support leg to aid in preventing each pier leg from sinking into, and moving with respect to, the underwater surface. Each base pad is detachable from each pier support leg, thus allowing the user to adjust the height of the pier leg should unleveling of the pier occur. The height adjustment process can include removing the support leg from the water to adjust its height, which is very difficult and impracticable to do if the base pad is not detachable from each pier support leg and thus difficult to remove from the underwater surface. To ensure easy installation of each base pad, tool-less fasteners attach each base pad to each pier support. Further, each base pad is configured to be easily removed from the underwater surface at a location above the water.

FIG. 1 depicts a schematic view of a pier 100 positioned over a body of water 102. The pier 100 includes a walking platform 101 and a plurality of support legs 104 that are supported on an underwater surface 106. A base pad 108 is positioned between each support leg 104 and the underwater surface 106. In some examples, each base pad 108 is attached to each support leg 104. In other examples, the base pad 108 is not attached to each support leg 104 and each support leg 104 rests, unattached, on top of each base pad 108.

Figure 2:
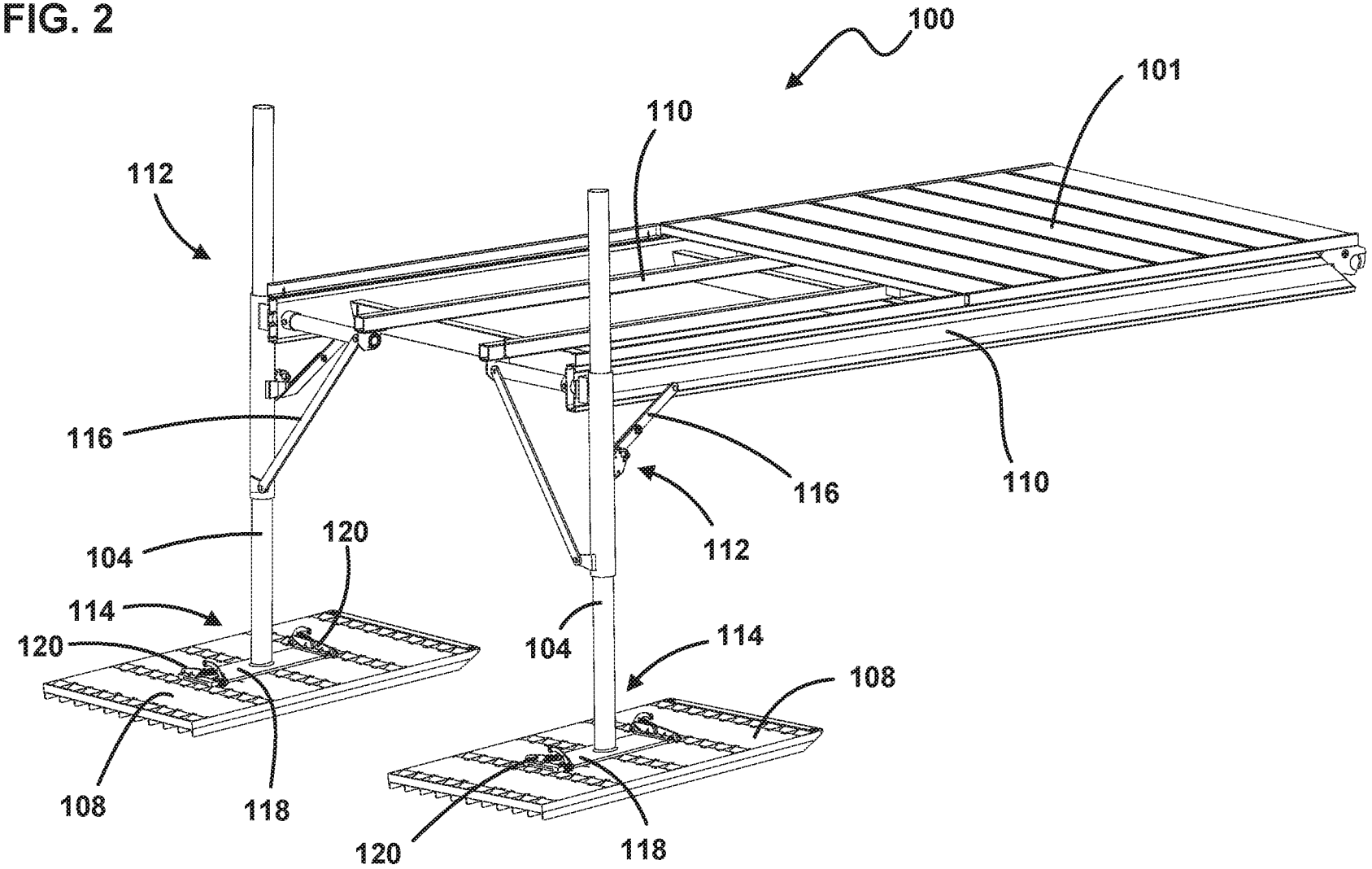
FIG. 2 illustrates a perspective view of a pier, according to one embodiment of the present disclosure.

FIG. 2 shows a perspective view of a pier 100. In some examples, the pier 100 can be a portion of a larger pier or dock structure. For example, as depicted, a plurality of piers 100 can be attached to one another to form a larger pier structure. The pier 100 includes the platform 101, the support legs 104, and a plurality of platform support rails 110.

The platform 101 rests upon the platform support rails 110. The platform 101 provides a surface for people walking along the pier 100 or a surface to store or support a variety of items. When installed, the platform 101 is configured to be positioned above the water 102. In some examples, the platform 101 can be removed from the support rails 110. In the depicted example, a single platform 101 is shown supported by the support rails 110. In some examples, the pier 100 can include a plurality of platforms 101.

The support legs 104 support the platforms 101 and the platform support rails 110 on the underwater surface 106, as shown in FIG. 1. The support legs 104 can be constructed in a variety of different ways. In the depicted example, the support legs 104 are elongate members that are generally perpendicular with the support rails 110. In other examples, the support legs 104 can be angled with respect to the support rails 110. In some examples, each support leg 104 can be interconnected with an additional support leg 104.

The support legs 104 include a top side 112 and a bottom side 114. The support legs 104 are connected to the support rails 110 at the top side 112. In some examples, braces 116 connect the support legs 104 to the support rails 110. At the bottom side 114, each support leg 104 includes a foot 118.

Each foot 118 of each support leg 104 is configured to interface with the underwater surface in order to stabilize the pier 100. It is contemplated, and considered within the scope of the present disclosure, that the feet 118 can be a variety of different shapes and sizes to effectively support the pier 100. In some examples, each foot 118 is a planar member that is configured to rest atop a base pad 108. In some examples, each foot 118 is secured to the base pad 108 with a pair of fasteners 120. In some examples, each foot 118 has a surface area that is smaller than the surface area of a top side 122 of the base pad 108.

The fasteners 120 are configured to secure each foot 118 to each base pad 108. In some examples, a single fastener 120 can be utilized to secure each foot 118. In other examples, at least two fasteners 120 are used to secure a single foot 118 to the base pad 108. In some examples, the fasteners 120 allow for tool-less coupling and decoupling of the fastener 120 to the base pad 108. In some examples, the fasteners 120 can be remotely operated to decouple the fastener 120 from a foot 118 and a base pad 108.

Figure 3:
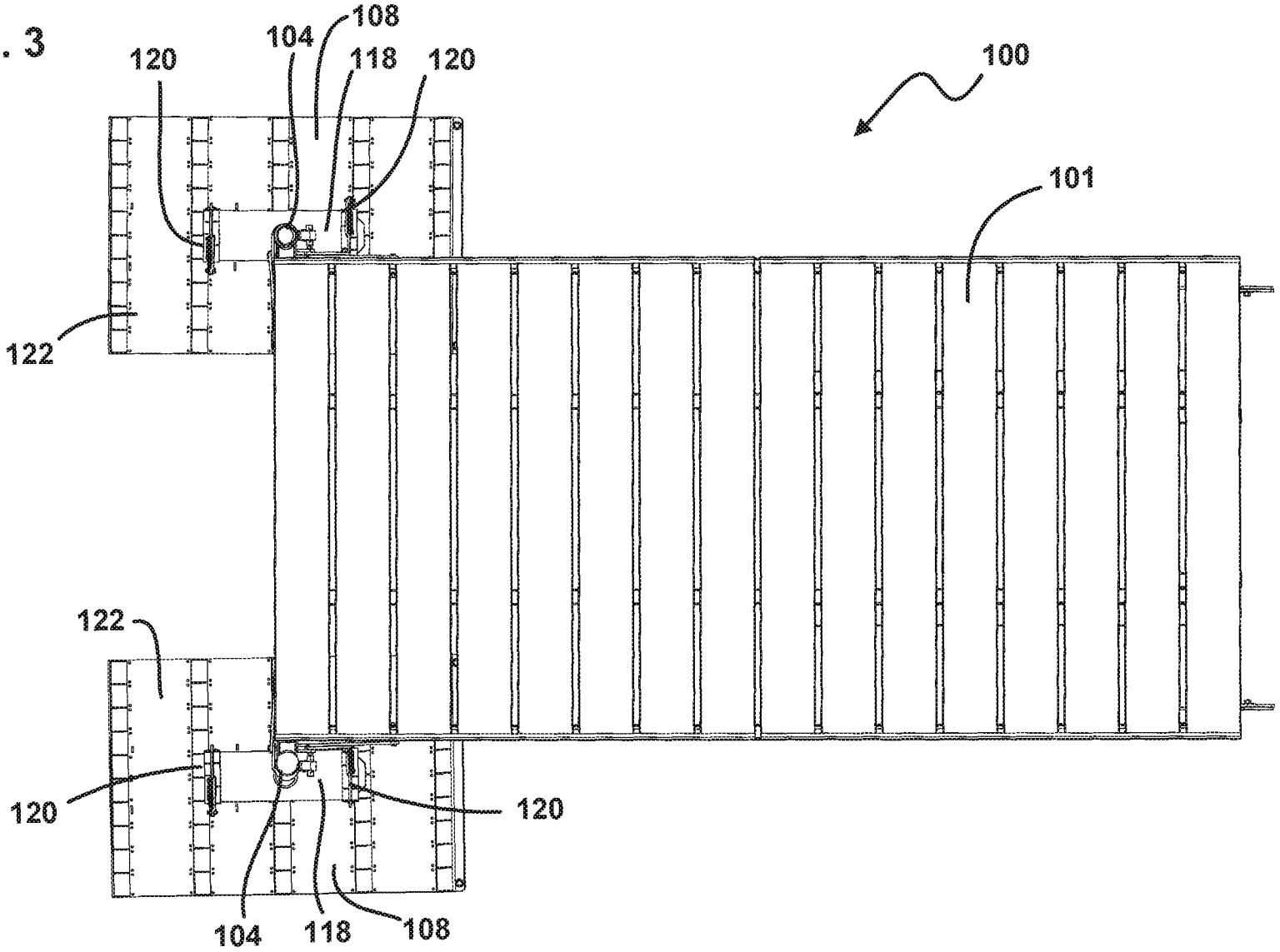
FIG. 3 illustrates a top view of the pier of FIG. 2.

FIG. 3 shows a top view of the pier 100. As shown, each foot 118 is centered on each base pad 108. Each foot 118 can be positioned on any portion of the top surface 122 of the base pad 108. In other examples, the pier 100 can include additional feet 118 that can correspond with additional base pads 108. For example, the pier 100 can include a center support leg between the two support legs 104 shown. The center leg can include a corresponding foot and base pad.

Figure 4:
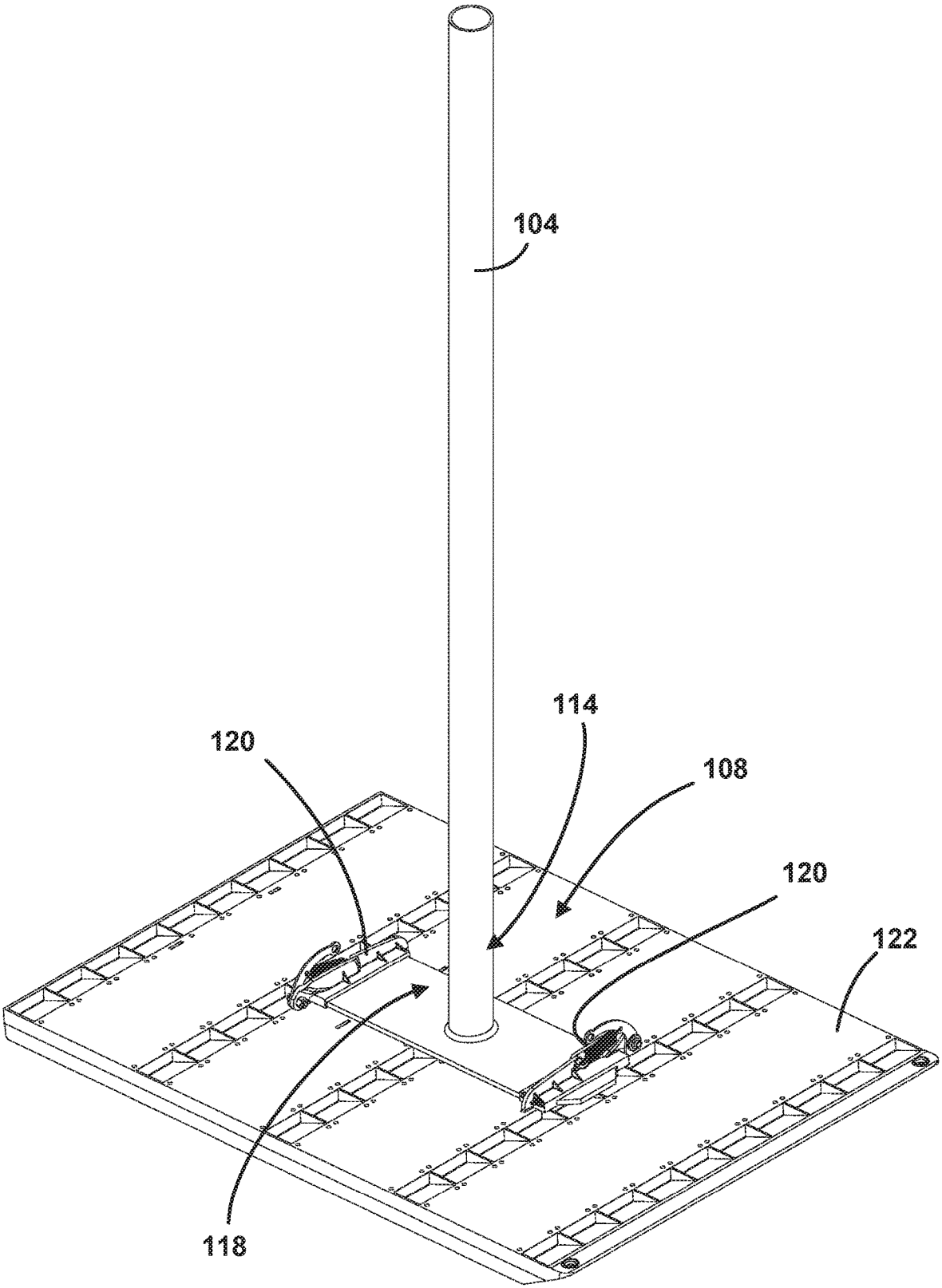
FIG. 4 illustrates a perspective view of a support leg coupled to a base pad, according to one embodiment of the present disclosure.

FIG. 4 shows a perspective view of the support leg 104 coupled to the base pad 108 via a pair of fasteners 120. The foot 118, fastener 120, and base pad 108 can be configured in a variety of different ways to facilitate properly supporting the pier 100.

Figure 5:
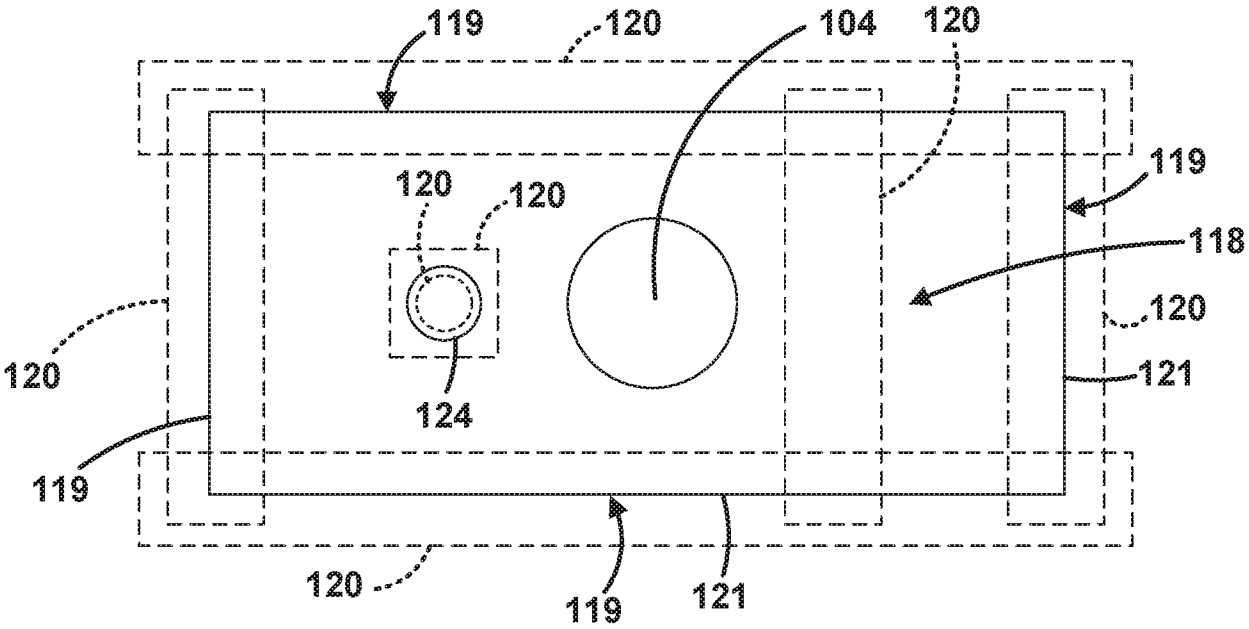
FIG. 5 illustrates a schematic example top side view of a foot of the support leg of FIG. 4.

FIG. 5 shows a top view of the foot 118. As shown, the fasteners 120 can be positioned in a variety of locations with respect to the foot 118. In some examples, a single fastener 120 can be used to secure the foot 118 to the base pad 108. In other examples, a fastener 120 can be used on at least two sides 119 of the foot 118. In some examples, the fasteners 120 can overlap a portion of the foot 118, such as an edge 121 or the side 119. In other examples, the foot 118 can include an aperture 124 that is configured to receive a fastener 120. The fastener 120 can be positioned within the aperture 124 to secure the foot 118 to the base pad 108.

Figure 6:
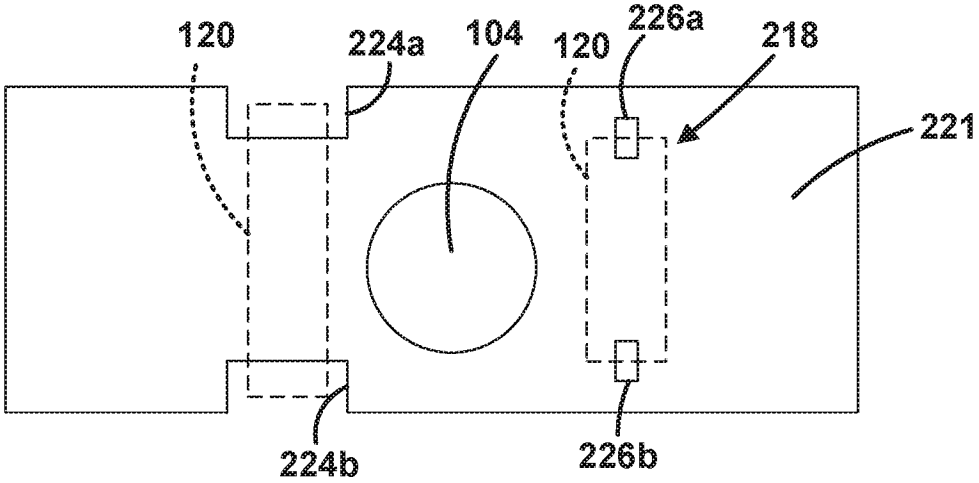
FIG. 6 illustrates another schematic example top side view of a foot of the support leg of FIG. 4.

FIG. 6 shows another example of a foot 218 attached to the support leg 104. As shown, the foot 218 includes at least one recess 224 that is configured to receive a portion of a fastener 120. In some examples, the foot 218 can include a pair of recesses 224*a*, 224*b*. In the depicted example, the fastener 120 is configured to be positioned within the recesses 224*a*, 224*b* to prevent relative movement between a base pad 108 and the foot 218. Alternatively, or in addition to the at least one recess 224, the foot 218 can also include at least one aperture 226 configured to receive a portion of a fastener 120. The fastener 120 can be partially positioned within the aperture 226 and partially on a top surface 222. In some examples, the fastener 120 is partially positioned within a pair of apertures 226*a*, 226*b* and partially on the top surface 222 of the foot 218. In such an example, the fastener 218 can engage the base pad 108, and secure the base pad 108 to the foot 218, through the apertures 226*a*, 226*b*.

Figure 7:
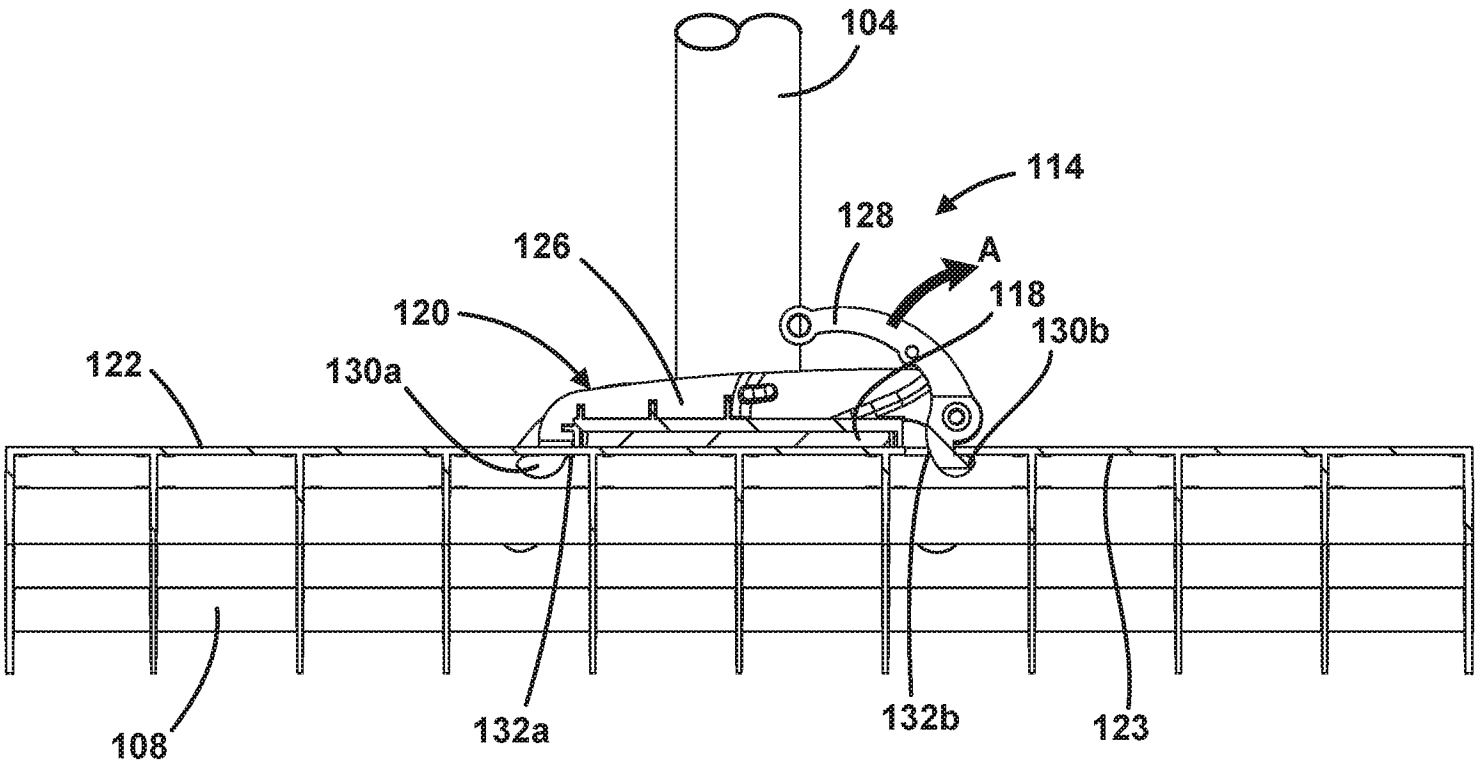
FIG. 7 illustrates a schematic cross-sectional view of the support leg and base pad of FIG. 4.

FIG. 7 shows a partial cross-sectional view through the fastener 120 of a support leg 104 coupled to a base pad 108 via the fastener 120. As shown, the fastener 120 includes a main body 126 and an arm 128 pivotally attached (as shown by the arrow A) to the main body 126. Both the main body 126 and the arm 128 include engagement features 130 that selectively engage with the base pad 108 to couple the fastener 120 to the base pad 108. In some examples, the fastener 120 is configured to at least partially engage with a bottom side 123, opposite of the top side 122, of the base pad 108. In some examples, the engagement features 130 engage with the bottom side 123 of the base pad 108 and are at least partially positioned within a fastener aperture 132. In some examples, the engagement features 130 are selectively positionable within a single fastener aperture 132 of the base pad 108. In other examples, the engagement features 130 are selectively positionable within two separate fastener apertures 132*a*, 132*b* of the base pad 108. In some examples, the engagement features 130 are also positionable within an aperture 124, 226 (shown in FIGS. 5 and 6) defined in the foot 118.

Figure 8:
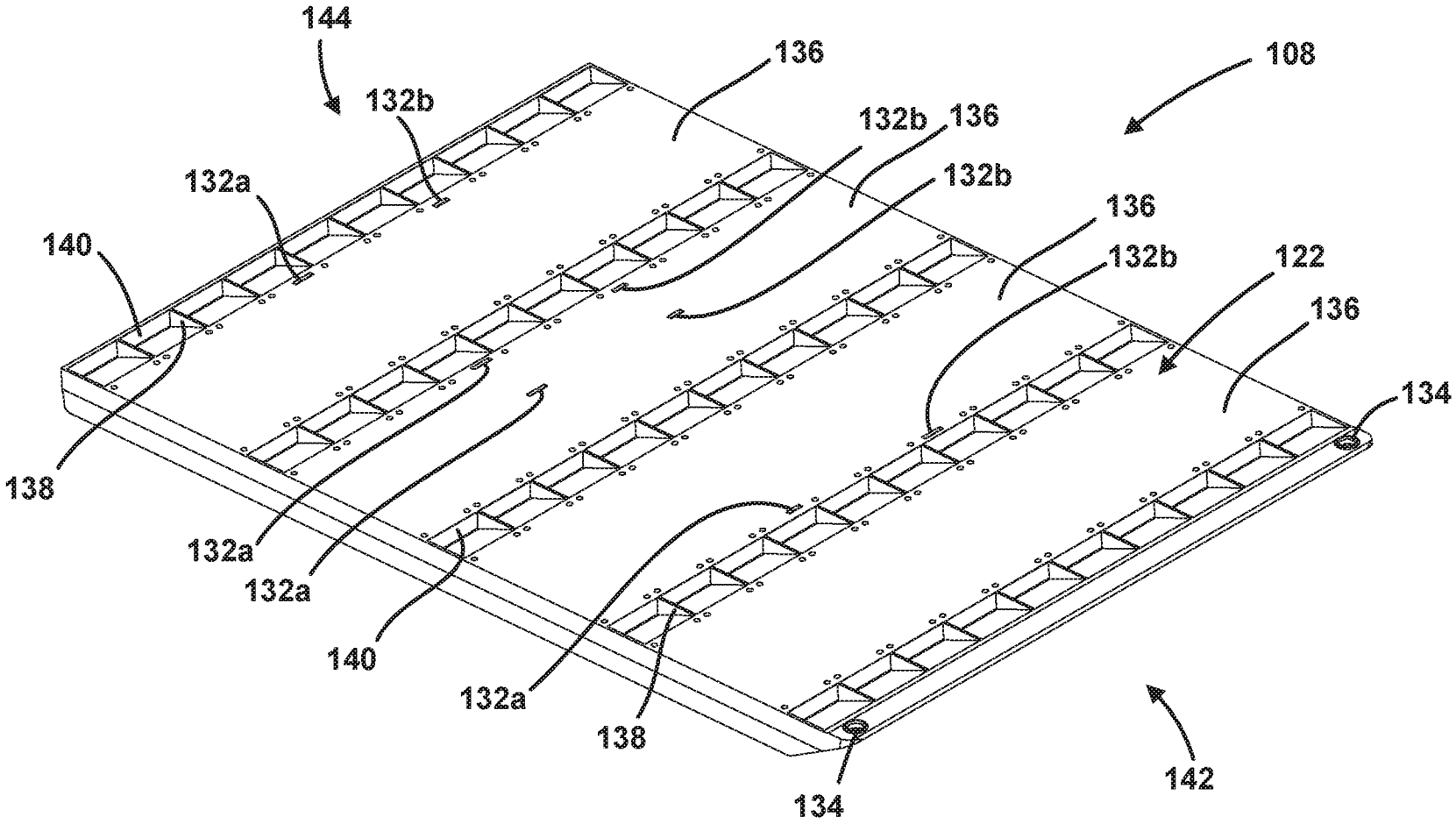
FIG. 8 illustrates a top perspective view of the base pad of FIG. 4.
Figure 9:
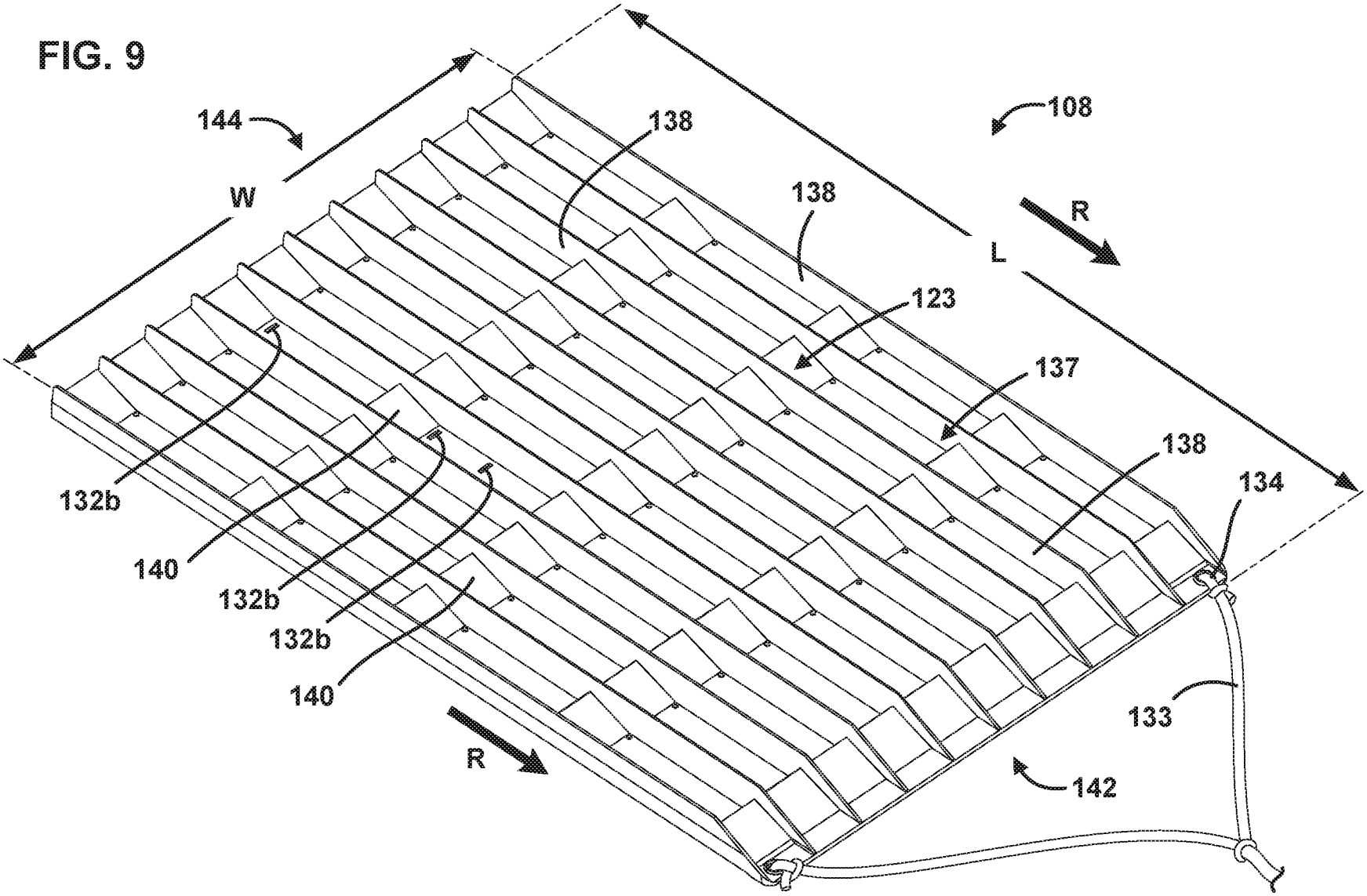
FIG. 9 illustrates a bottom perspective view of the base pad of FIG. 4.
Figure 10:
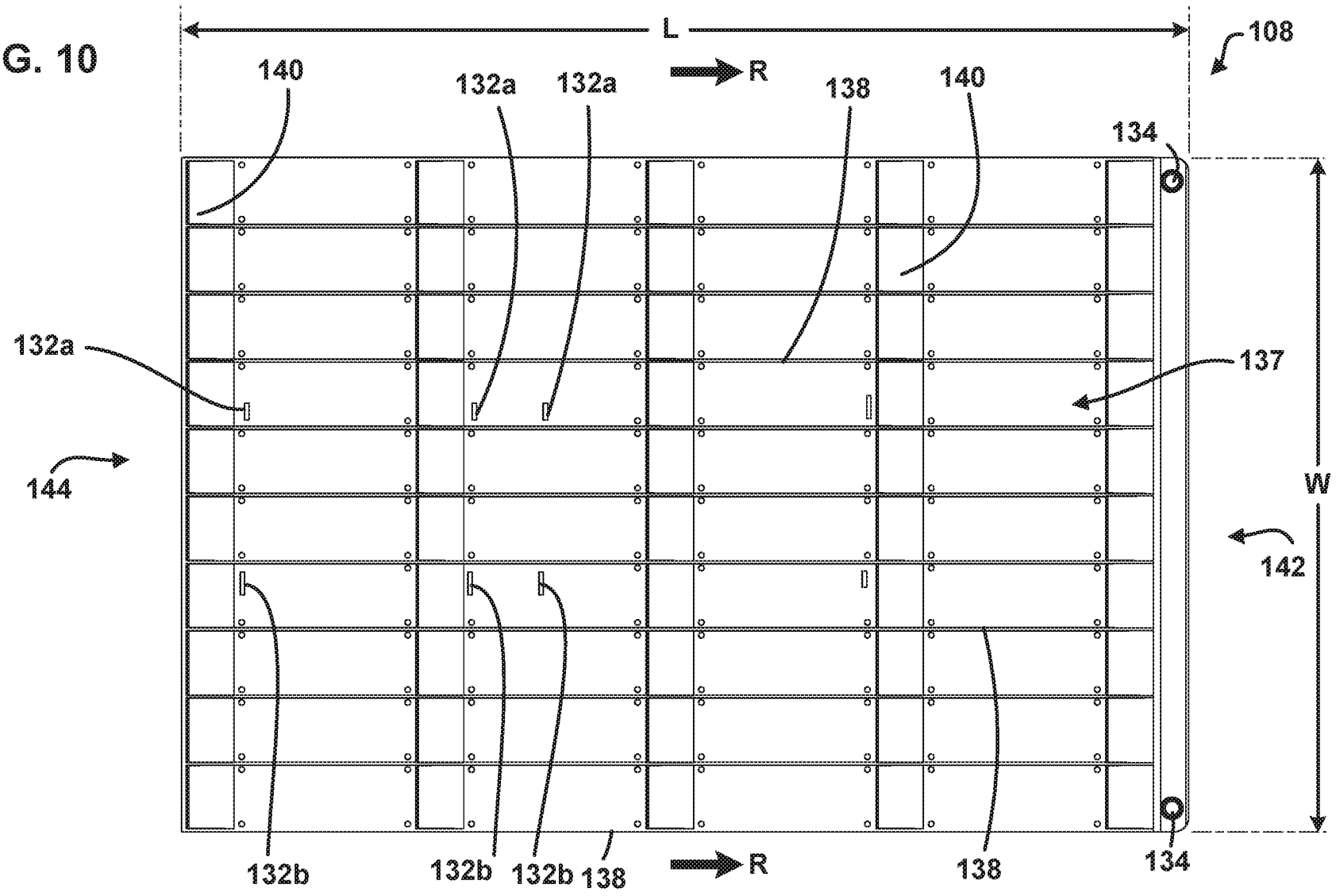
FIG. 10 illustrates a bottom side view of the base pad of FIG. 4.

FIG. 8 shows a perspective top view of the base pad 108. FIG. 9 shows a perspective bottom view of the base pad 108. FIG. 10 shows a bottom view of the base pad 108.

The base pad 108 includes the top side 122, bottom side 123, the fastener apertures 132*a*, 132*b*, at least one removal feature 134, at least one flat section 136, a plurality of longitudinal ribs 138, and a plurality of lateral ribs 140. Further, the base pad 108 includes a front side 142 and a rear side 144.

As noted above, the base pad 108 is configured to be removed from the underwater surface 106 at a location above the water. Underwater surfaces 106 can be a variety of different types (e.g., silt, sand, mud, etc.), each providing a particular challenge. However, the base pad 108 is configured to stably support the pier 100 and be easily removed from underwater surfaces 106 of all types. Specifically, the base pad 108 is configured to reduce the force required by a user to remove the base pad 108 from an underwater surface 106. In some examples, the base pad 108 is configured to be removed in a removal direction R after the pier is removed 100.

The top side 122 of the base pad 108 is configured to engage with at least one support leg 104 of the pier 100. In some examples, the top side 122 of base pad 108 is configured to receive a plurality of support legs 104 of the pier 100. In some examples, the top side 122 includes at least one flat section 136 to receive the foot 118 of the support leg 104. In some examples, the at least one flat section 136 covers the entire surface area of the top side 122. In other examples, the at least one flat section 136 covers a portion less than the entire surface area of the top side 122. In other examples, the top side can include a plurality of flat sections 136 at the top side 122.

As shown in FIGS. 9 and 10, the bottom side 123 of the base pad 108 is configured to interface with the underwater surface 106. The bottom side is configured to grip the underwater surface 106 while also being configured to be easily removed from the underwater surface. In some examples, the bottom surface 123 can include underwater surface gripping features 137 that are configured to engage the underwater surface 106 to prevent relative movement between the base pad 108 and the underwater surface 106. In some examples, the surface gripping features 137 are the ribs 138 and 140. In other examples, the surface gripping features 137 include protrusions (e.g., stakes). In other examples, the surface gripping features 137 can include stakes (not shown) that are hingedly attached to the bottom side 123 of the base pad 108. In other examples, the surface gripping features 137 include at least one protrusion and at least one recess.

The fastener apertures 132*a*, 132*b* are configured to receive portions of the fastener 120. As shown, the base pad 108 defines a plurality of fastener apertures 132*a*, 132*b*. In some examples, each pair of fastener apertures 132*a*, 132*b* correspond with one another to receive a fastener 120. The base pad 108 includes a plurality of pairs of fastener apertures 132*a*, 132*b*, defined at a variety of locations on the base pad 108 to allow for a variety of different positions of a fastener 120 and a corresponding foot 118 on the top side 122 of the base pad 108. In some examples, the apertures 132*a*, 132*b* can be slots, circular holes, or other like apertures to receive a variety of different fasteners 120.

Figure 19:
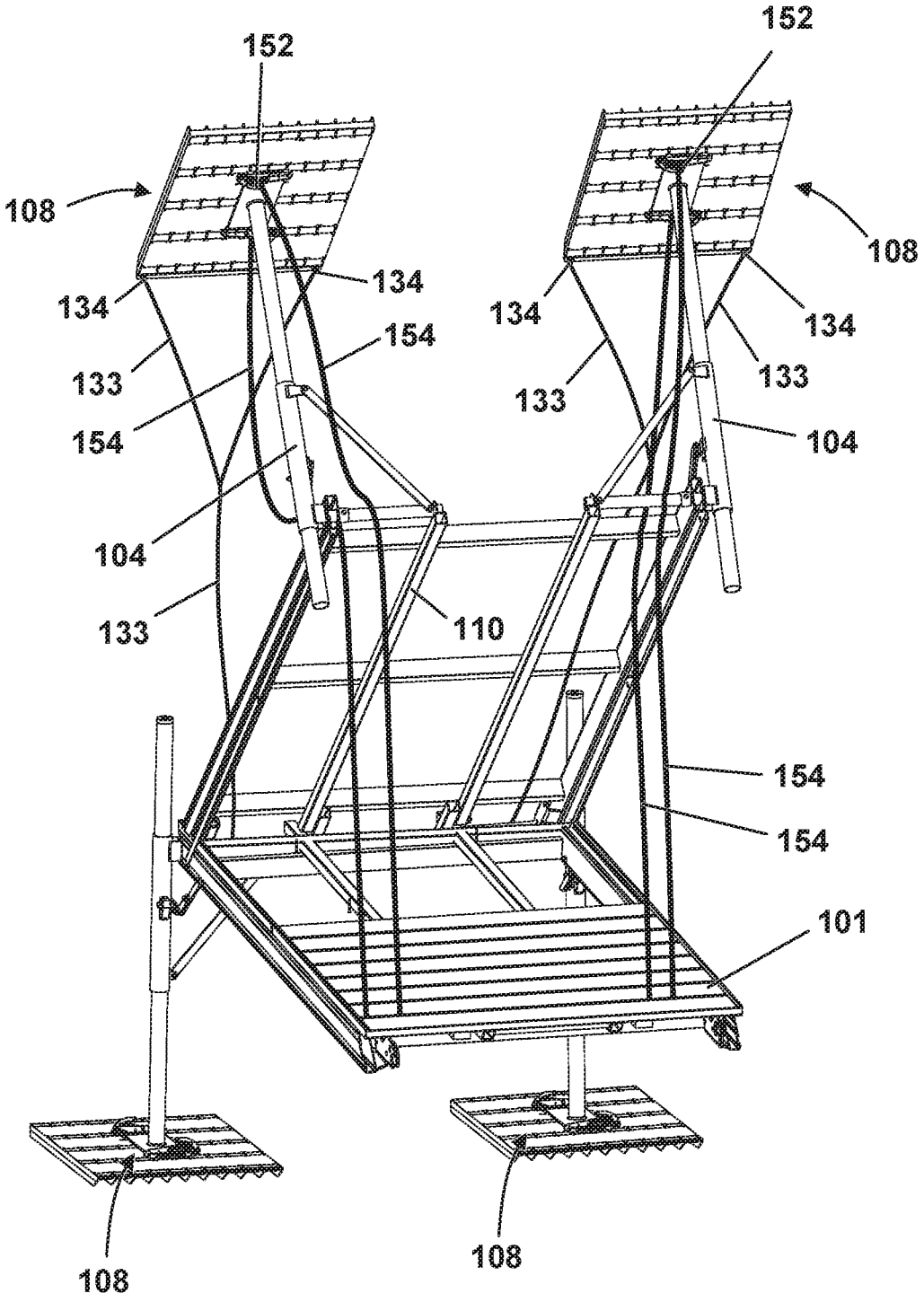
FIG. 19 illustrates a perspective view of the pier of FIG. 17 with base pads and fasteners installed.

The at least one removal feature 134 is located at the front side 142 of the base pad 108. The removal feature 134 is configured to be attached to a removal device 133 (shown in FIG. 19) to facilitate the remote removal of the base pad 108 from the underwater surface 106. In some examples, the base pad 108 can include a plurality of removal features 134. In some examples, the at least one removal feature 134 is an aperture defined in the base pad 108. In other examples, the at least one removal feature 134 (i.e., clevis, eyelet, or other similar attachment) is attached to the base pad 108. The removal feature 134 can be configured to receive a variety of different removal devices 133 such as a cord, cable, hook, chain, or other similar devices.

The longitudinal ribs 138 extend between the front side 142 and the rear side 144 of the base pad 108. In some examples, the base pad 108 can include a plurality of the longitudinal ribs 138 positioned generally parallel to one another. In some examples, the longitudinal ribs 138 are consistently spaced across a width W of the base pad 108. In some examples, the longitudinal ribs 138 increase the rigidity and strength of the base pad 108. In some examples, the longitudinal ribs 138 are ramped at a portion adjacent the front side 142 of the base pad 108. The longitudinal ribs 138 are aligned with the removal direction R and ease the movement of the base pad 108 in the removal direction R, while also aiding in preventing lateral movement or shifting of the base pad 108 when installed on the underwater surface 106.

The lateral ribs 140 are positioned generally transversely to the longitudinal ribs 138. The lateral ribs 140 are generally spaced along a length L of the base pad 108 and each travel at least a portion of the width W of the base pad 108. In some examples, the lateral ribs 140 increase the rigidity and strength of the base pad 108 In some examples, the lateral ribs 140 can be angled in a way with respect to the longitudinal ribs 138 forming barbs to facilitate ease of removal of the base pad 108 in the removal direction R and to reduce movement of the base pad 108 in a direction opposite of the removal direction R. In some examples, the lateral ribs 140 are angled away from the direction of removal R from the top side 122 to the bottom side 123 of the base pad 108.

Working together, the longitudinal ribs 138 and the lateral ribs 140 are configured to reduce relative movement of the base pad 108 in an underwater surface 106. The base pad 108 facilitates easier and faster leveling of the support legs 104 and corresponding pier 100 because the base pad 108 is prevented from moving and becoming unlevel on the underwater surface 106. The base pad 108, due to its configurations, is resistant to sinking into the underwater surface 106.

The base pad 108 can be constructed of a rigid material. In some examples, the bad pad 108 is constructed from aluminum. In other examples, the base pad 108 can be constructed of a plastic, such as PVC or ABS.

Figure 11:
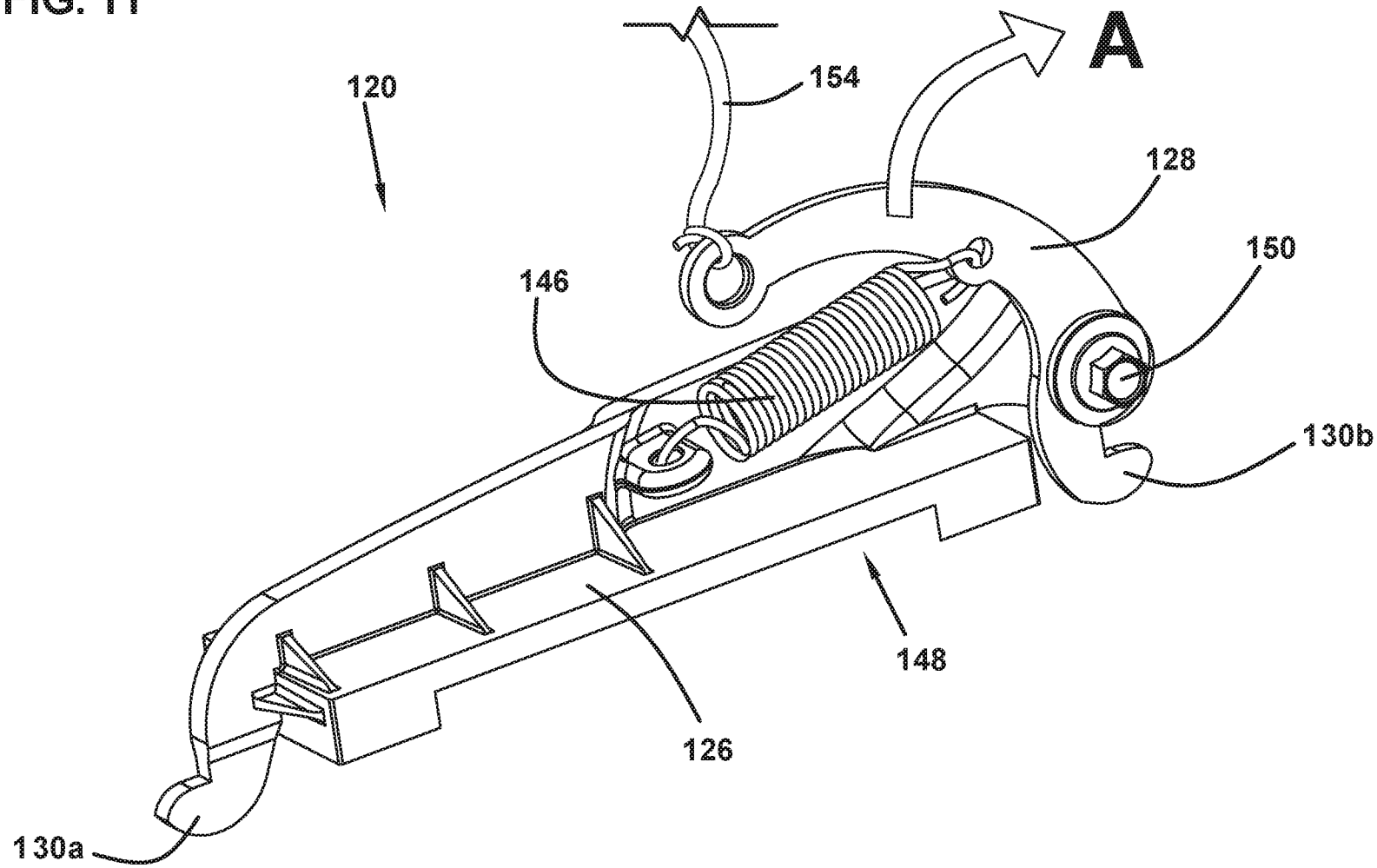
FIG. 11 illustrates a perspective view of a fastener, according to one embodiment of the present disclosure.
Figure 12:
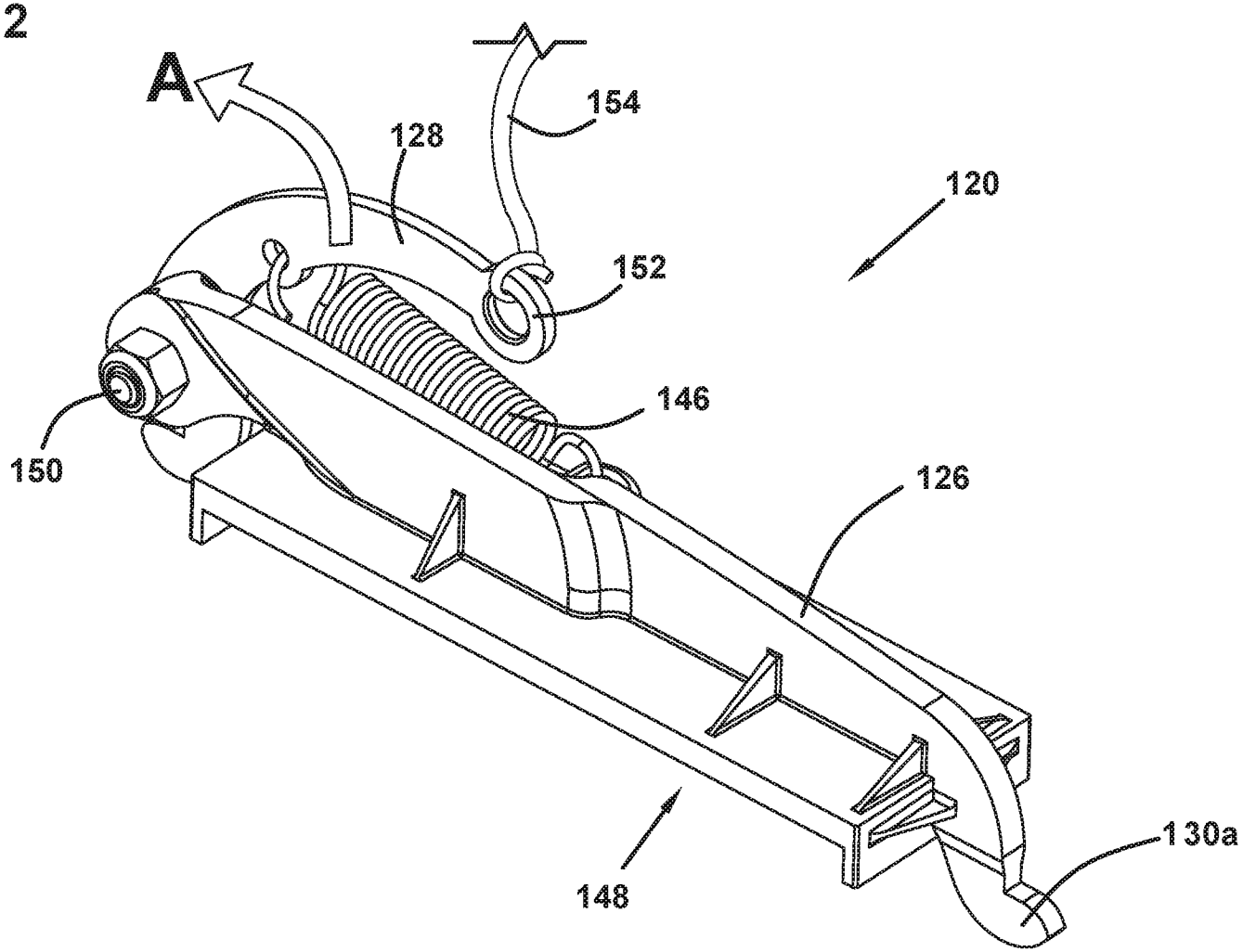
FIG. 12 illustrates another perspective view of the fastener of FIG. 11.
Figure 13:
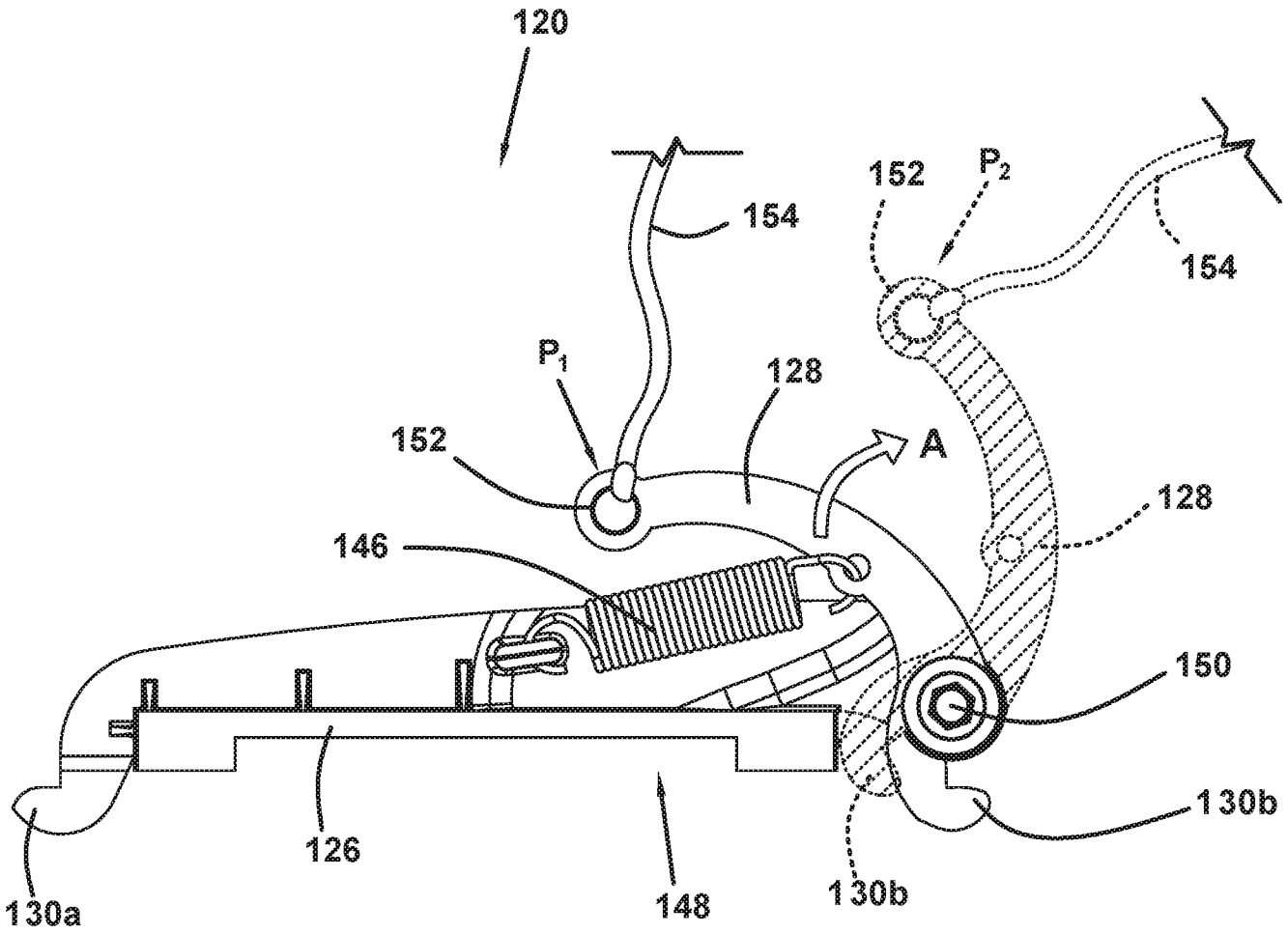
FIG. 13 illustrates a side view of the fastener of FIG. 11.

FIG. 11 shows a perspective view of the fastener 120. FIG. 12 shows another perspective view of the fastener 120, and FIG. 13 shows a side view of the fastener 120. As shown, the fastener 120 includes the main body 126 and the arm 128 pivotally attached (as shown by the arrow A) to the main body 126. The engagement features 130 of both the main body 126 and arm 128 are shown to be hook-like features. In the depicted embodiment, the fastener 120 also includes a spring 146 that connects the main body 126 with the arm 128.

The fastener 120, and specifically the arm 128, has a first position P1 and a second position P2, as shown in FIG. 13. In the first position P1, the fastener 120 is configured to be coupled to the base pad 108. In the second position P2, the fastener 120 is configured to be decoupled from the base pad 108.

In the depicted embodiment, the main body 126 includes a channel 148 that is configured to engage the foot 118 of the support leg 104. In some examples, the main body 126 includes a plurality of engagement features 130*a*, 130*b*.

The arm 128 is pivotally attached to the main body 126 at a pivot point 150 and attached to the main body 126 by the spring 146. As shown in FIG. 13, as the arm 128 is pivoted about pivot point 150, the engagement feature 130*a*, 130*b* also moves with the arm 128. This allows engagement feature 130*a*, 130*b* to be coupled and decoupled from the base pad 108 by the movement of the arm 128 in the direction A.

The arm 128 also includes a removal feature 152. The removal feature 152 is configured to securely receive a removal device 154 to allow the fastener 120 to be toggled between the first and second positions P1, P2. In some examples, the removal feature 152 is an eyelet defined by the arm 128. In other examples, the removal feature 152 (for example, a clevis, hook, or other similar device) is attached to the arm 128. In some examples, the spring 146 biases the arm 128 to the first position P1.

Figure 14:
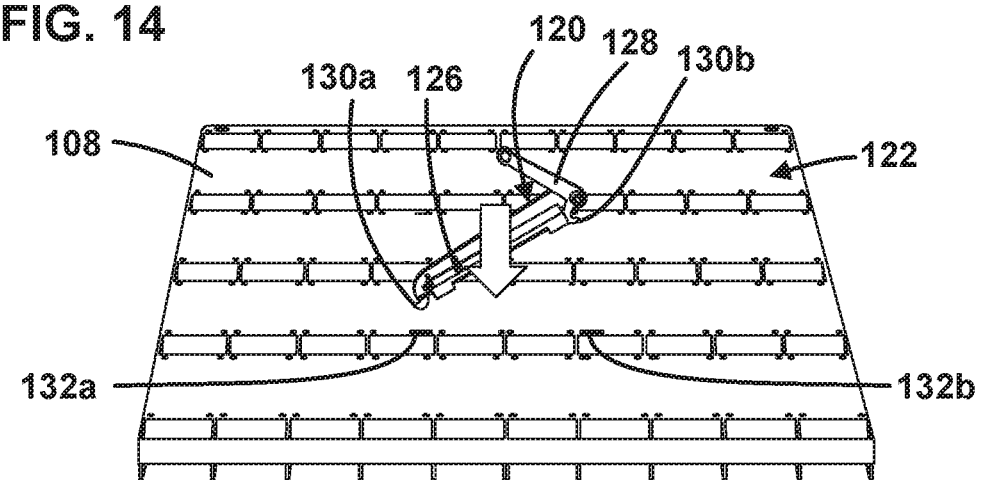
FIG. 14 illustrates a perspective view of coupling the fastener of FIG. 11 with the base pad of FIG. 8.
Figure 15:
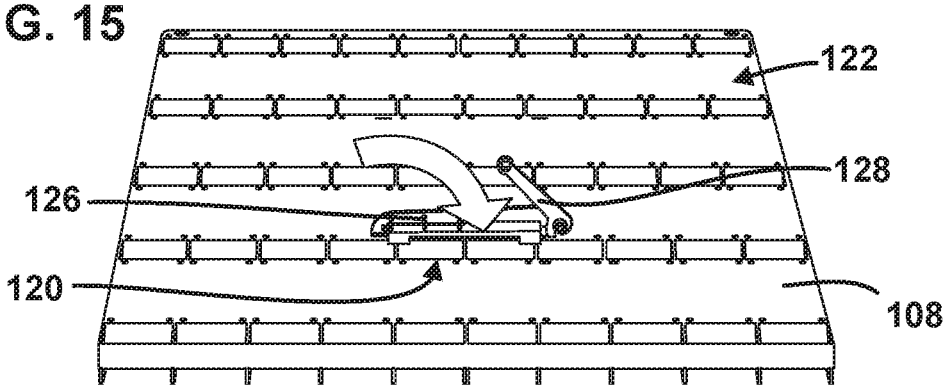
FIG. 15 illustrates another perspective view of coupling the fastener of FIG. 11 with the base pad of FIG. 8.
Figure 16:
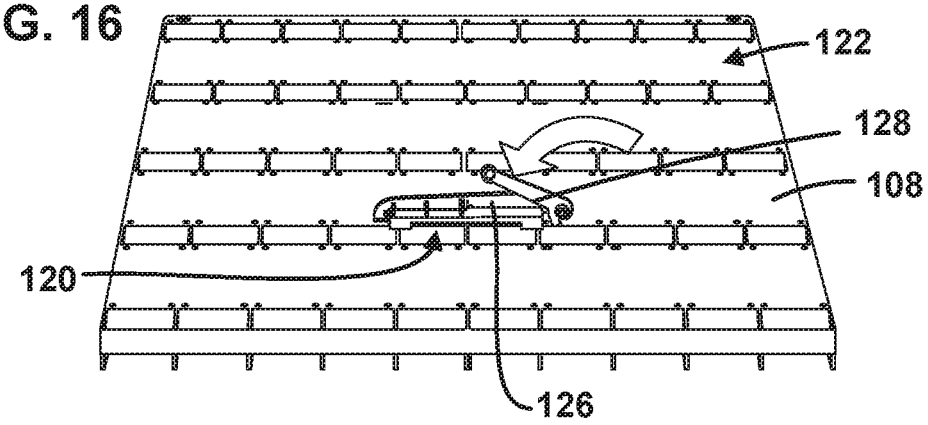
FIG. 16 illustrates another perspective view of coupling the fastener of FIG. 11 with the base pad of FIG. 8.

FIGS. 14-16 show the coupling of the fastener 120 to the base pad 108. As shown in FIG. 14, the engagement feature 130*a* of the main body 126 is aligned and positioned within the fastener aperture 132*a*. Once positioned within the fastener aperture 132*a*, the engagement feature 130*b* of the arm 128 is lowered into, and positioned within, the corresponding fastener aperture 132*b*, as shown in FIG. 15. When lowering the engagement feature 130*b* of the arm 128 into the fastener aperture 132*b*, the arm 128 is in the second position P2. In some examples, the arm 128 must be held in the second position to overcome the spring 146 attempting to bias the arm 128 to the first position P1. Once both the engagement features 130*a*, 130*b* are positioned within the fastener apertures 132*a*, 132*b*, the arm 128 is rotated toward the main body 126. In some examples, the arm 128 will automatically rotate toward the main body 126 via the spring 146.

Figure 17:
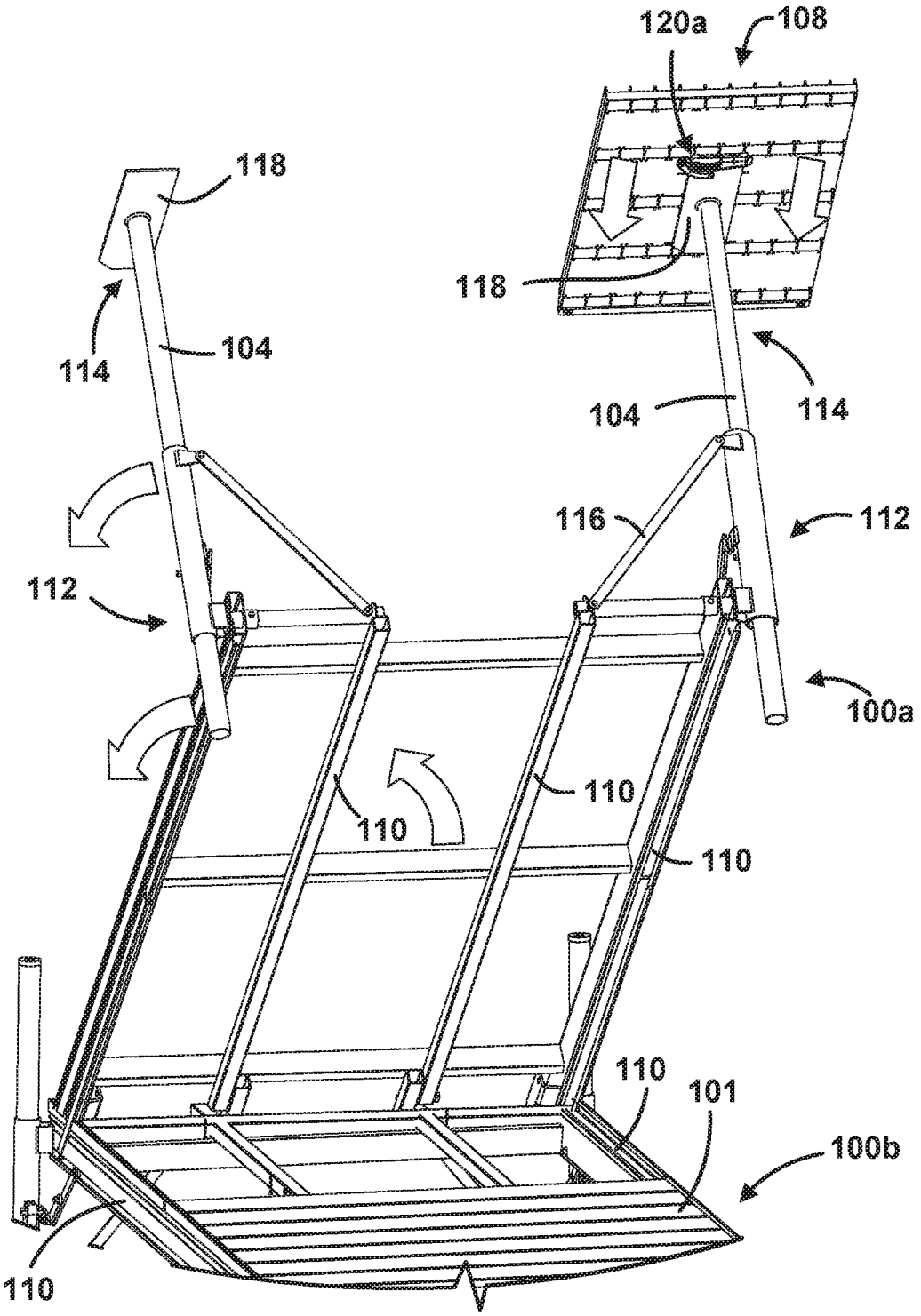
FIG. 17 illustrates a perspective view of an example installation step of coupling the fastener of FIG. 11 and base pad of FIG. 8 to an example pier, according to one embodiment of the present disclosure.

FIGS. 17-22 depict an example process of installing the base pad 108 on the support leg 104 of the pier 100. While the water is not shown, it is appreciated that the water surface lies at a point below the platform 101. FIG. 17 shows a first pier section 100*a* being installed with a second pier section 100*b*. As shown, the first pier section 100*a* can be pivotally attached to the second pier section 100*b* prior to being installed into the water. However, as noted above, it is considered within the scope of the present disclose that the pier 100 can have a variety of different configurations while being compatible with the base pads 108.

The base pad 108 is first installed onto a foot 118 of the support leg 104 by a fastener 120*a*. In the example shown in FIG. 17, the fastener 120*a* is first coupled to the base pad 108 and then the foot 118 can be slid into the channel 148 of the fastener 120*a*. In other examples, the fastener 120*a* can be coupled to the base pad 108 and simultaneously capture the foot 118 between fastener 120*a* and the base pad 108.

Figure 18:
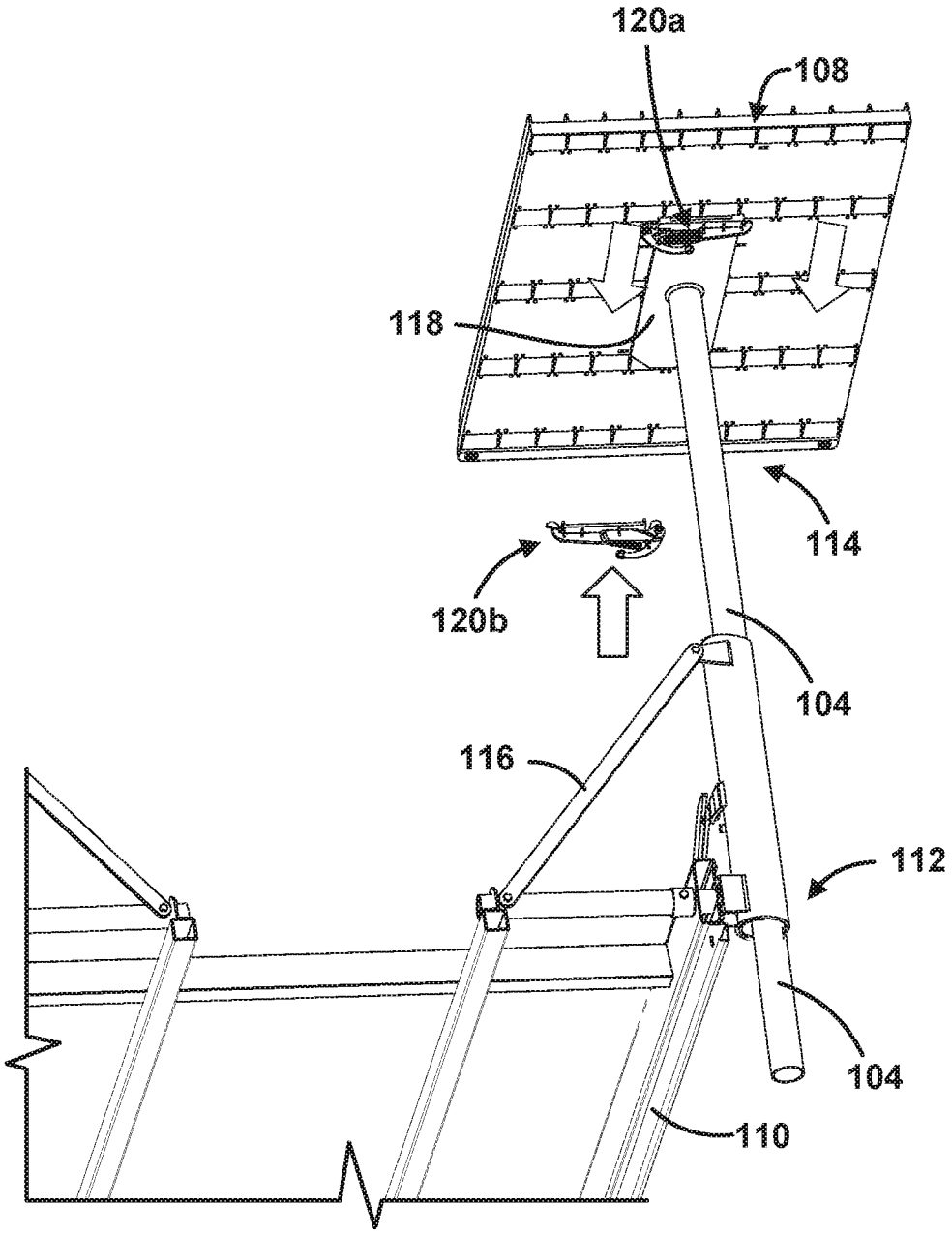
FIG. 18 illustrates a perspective view of an example installation step of coupling an additional fastener to the base pad of FIG. 8.

After the first fastener 120*a* is coupled to the base pad 108, an optional second fastener 120*b*, as shown in FIG. 18, is coupled to the base pad 108, thereby further capturing the foot 118 between the fastener 120*b* and the base pad 108. This process can be repeated for additional support legs 104 and base pads 108 of the pier 100.

In some examples, in order to facilitate remote operation of the fasteners 120 and remote removal of the base pads 108 from above the water 102 (i.e., while the user stands on the platform 101), a plurality of removal devices 133, 154 are attached to the removal features 134, 152 of the fasteners 120 and base pads 108, respectively. In some examples, removal devices 133, 154 are cords, cables, chains, or other similar device. The user can attach the removal devices 133, 154 to the fasteners 120 and base pads 108 prior to or after installation of the base pad 108 on each foot 118.

Figure 20:
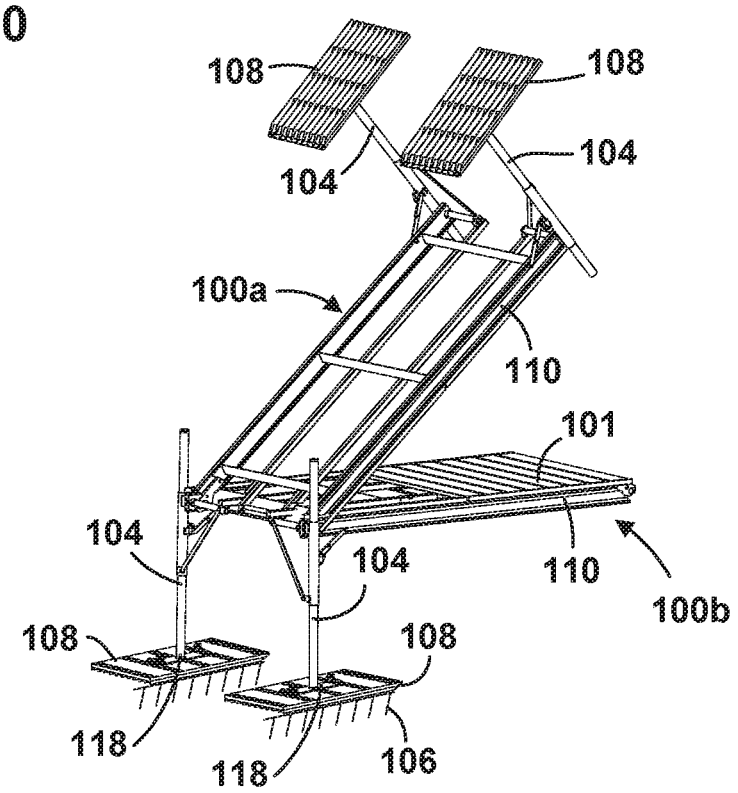
FIG. 20 illustrates a perspective view of an example installation step of installing the pier of FIG. 17 onto an underwater surface.
Figure 21:
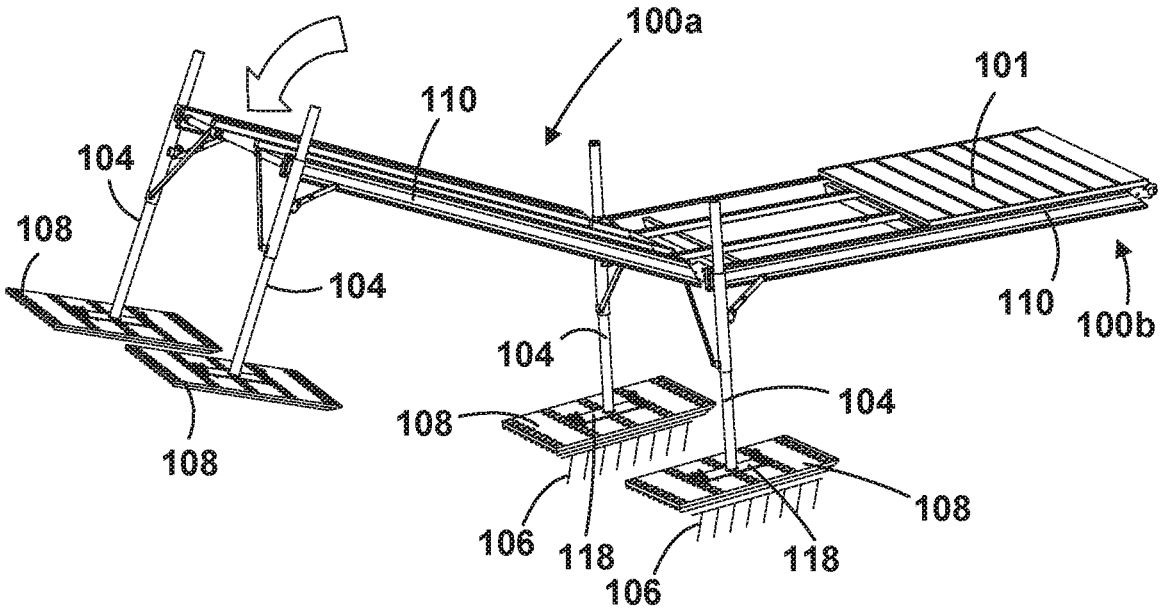
FIG. 21 illustrates a perspective view of another example installation step of installing the pier of FIG. 17 onto the underwater surface.
Figure 22:
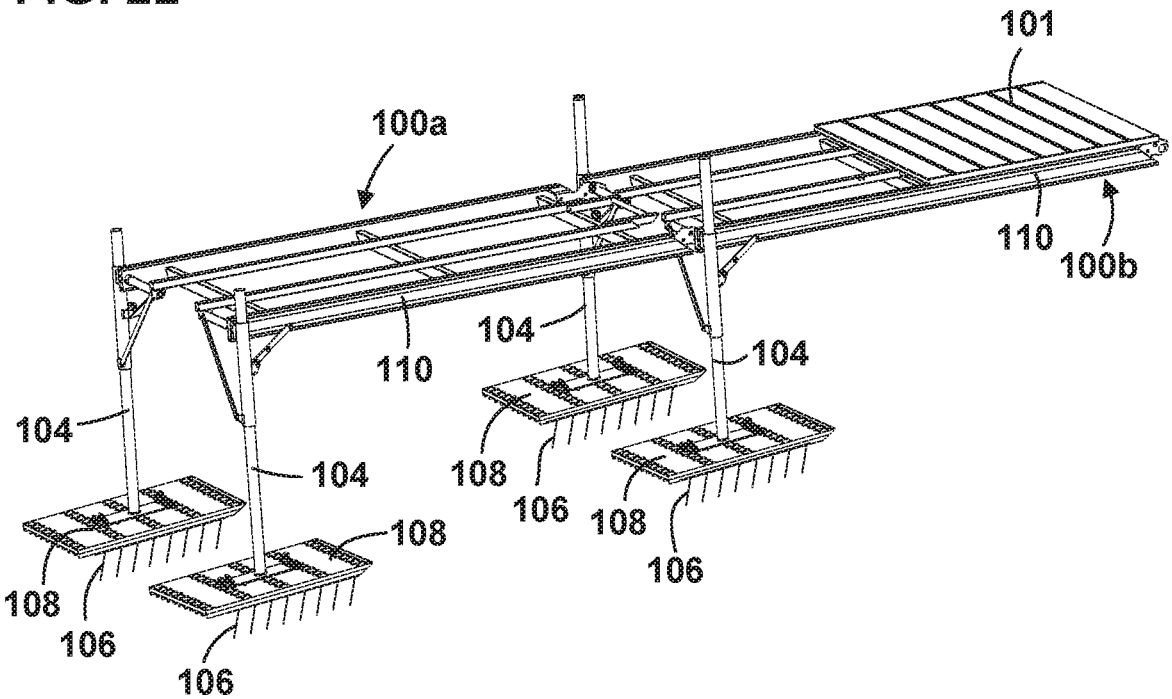
FIG. 22 illustrates a perspective view of another example installation step of installing the pier of FIG. 17 onto the underwater surface.

FIGS. 20-22 shows the lowering and pivoting of the first pier section 100*a* with respect to the second pier section 100*b*. Such lowering can be controlled by a user standing on the platform 101, thereby removing the need for the user to be submerged in the water. As the first pier section 100*a* is pivoted downward, the base pads 108 are retained on the feet 118 of the support legs 104 by the fasteners 120.

Figure 23:
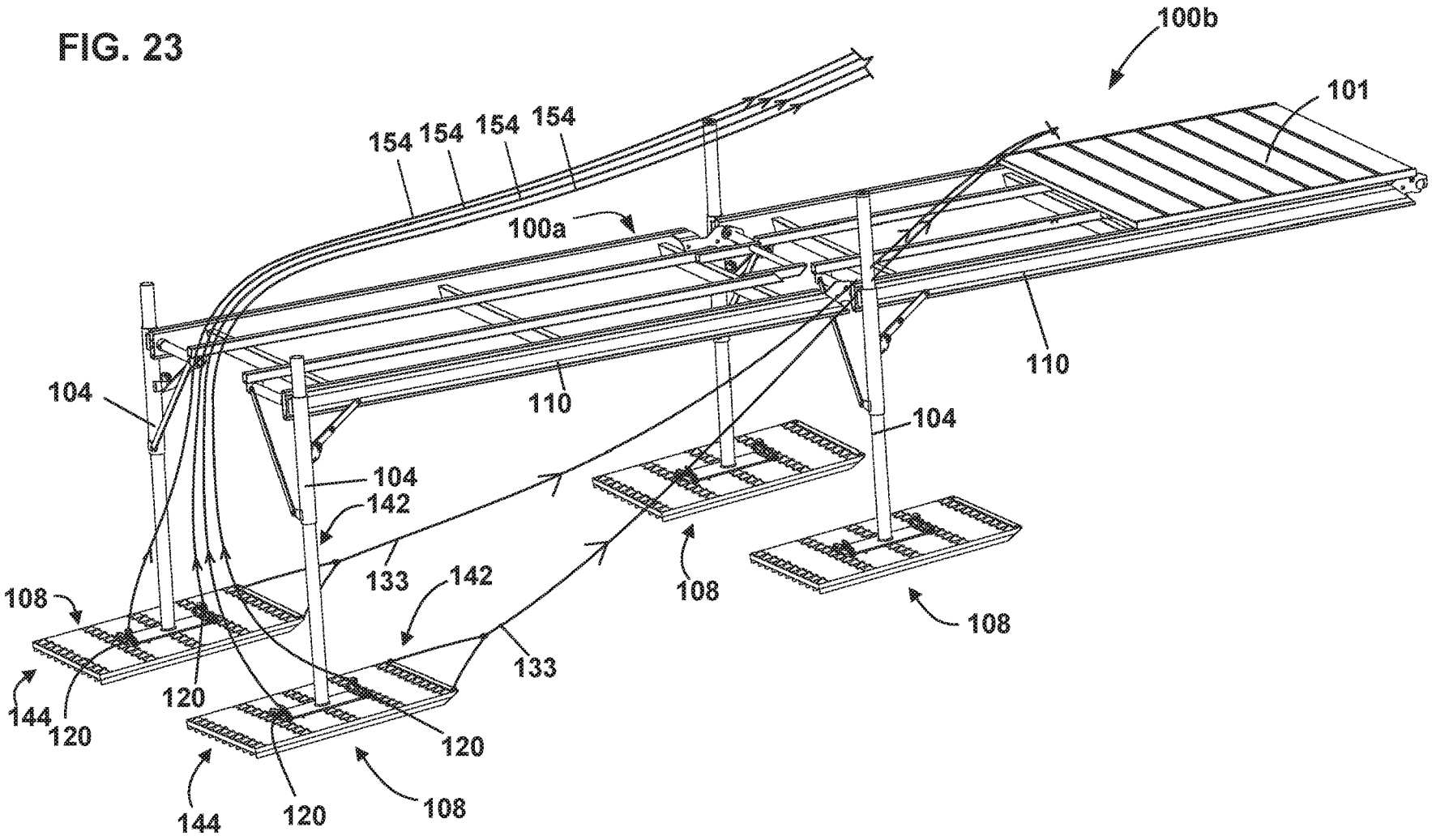
FIG. 23 illustrates a perspective view of the pier of FIG. 17 showing an example removal step of the fasteners from the base pads.

As shown in FIG. 23, once completely lowered, the user can then, optionally, remotely decouple each fastener 120 from the base pads 108 on the first pier section 100*a* via the removal devices 133. Such decoupling is facilitated by the tool-less features of the arm 128 of the fastener 120. As the removal devices 133 are pulled by the user, the arm 128 pivots to the second position P2, thereby decoupling the fastener 120 from the base pad 108. Due to the weight of the pier 100 and the size of the base pads 108, the feet 118 will remain positioned on the top surface 122 of the base pad 108, even without the fasteners 120 coupling the feet 118 to the base pad 108. By removing the fasteners 120 via the removal devices 133 at a remote location, the user does not have to enter the water to remove the fasteners 120. This allows the user to reuse the fasteners 120 on additional pier sections with additional base pads 108.

Figure 24:
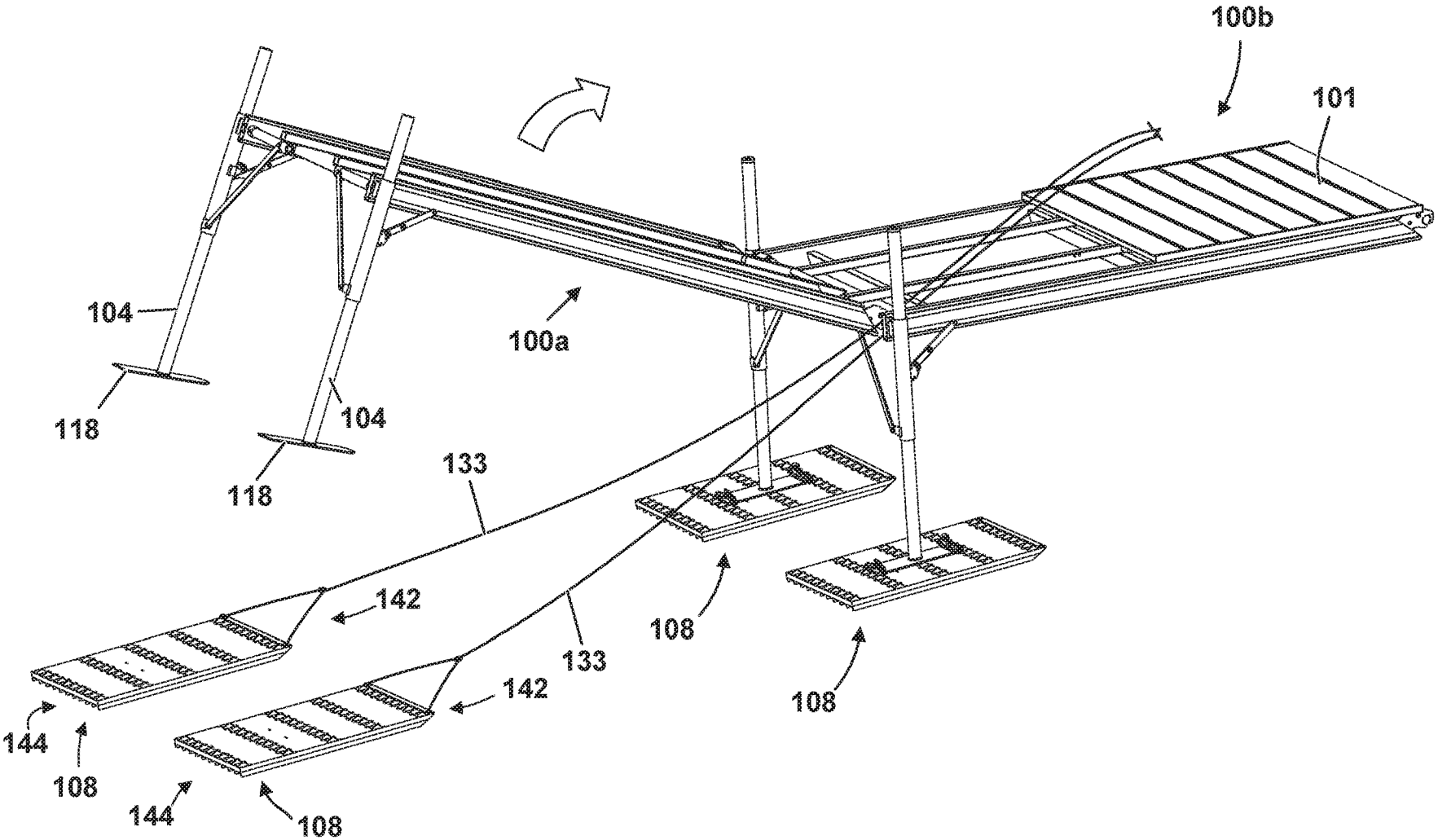
FIG. 24 illustrates a perspective view of an example removal step of removing the pier of FIG. 17 from the underwater surface.
Figure 25:
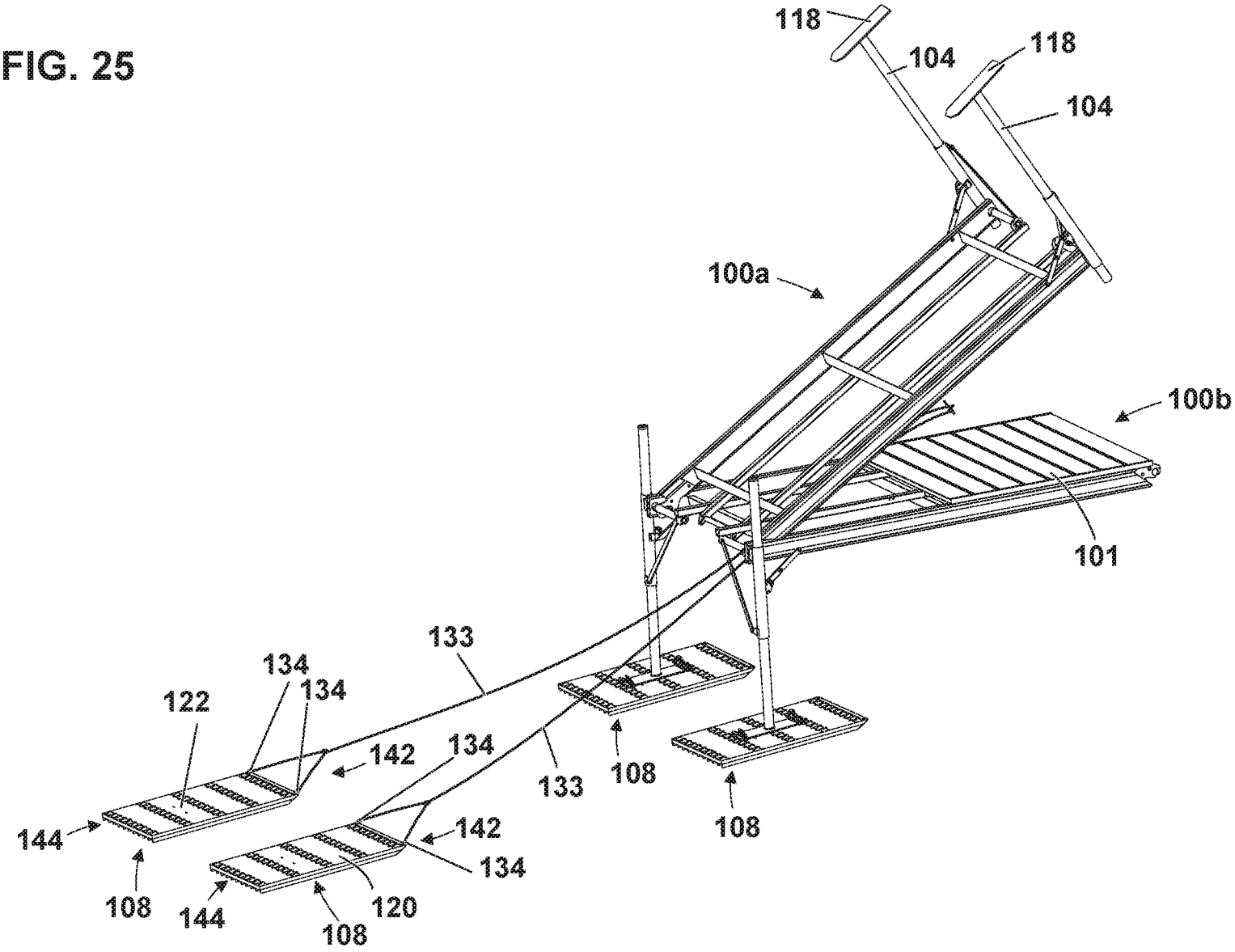
FIG. 25 illustrates a perspective view of another example removal step of removing the pier of FIG. 17 from the underwater surface.

FIGS. 23-26 depicted an example removal process of the base pads 108 from the water 102. While the water is not shown, it is appreciated that the water surface lies at a point below the platform 101. As shown in FIGS. 24-25, the first pier section 100*a* is pivoted out of the water 102 with respect to the second pier section 100*b*. This removal process can occur when the user choses to completely remove the pier sections 100*a*, 100*b* from the water (e.g. seasonal removal for winter) or it can occur as the user is installing the pier section 100*a* (i.e. seasonal install in the spring). As the user installs the pier sections 100*a*, 100*b* it is often desired to achieve a level platform 101 once the pier section 100*a*, 100*b* is installed. To achieve this, the user may have to remove and insert the pier section 100*a*, 100*b* multiple times while adjusting the heights of the support legs 104 to achieve a level platform 101. Thus, the ease of removal of the pier section 100*a*, 100*b* is important to facilitate such a leveling process.

During this removal process, because the base pads 108 have been decoupled from the feet 118 of the support legs 104 of the first pier section 100*a*, the base pads 108 remain on the underwater surface 106 after the first pier section 100*a* is removed from the water 102. By decoupling the base pads 108, the user does not need to overcome any additional force caused by the feet 118 becoming stuck in the underwater surface 106, as the feet 118 have been positioned only on the top surfaces 122 of the base pads 108 while installed. Further, this allows the base pads 108 to be a size that reduces sinking without having to consider removal of the support legs 104.

Figure 26:
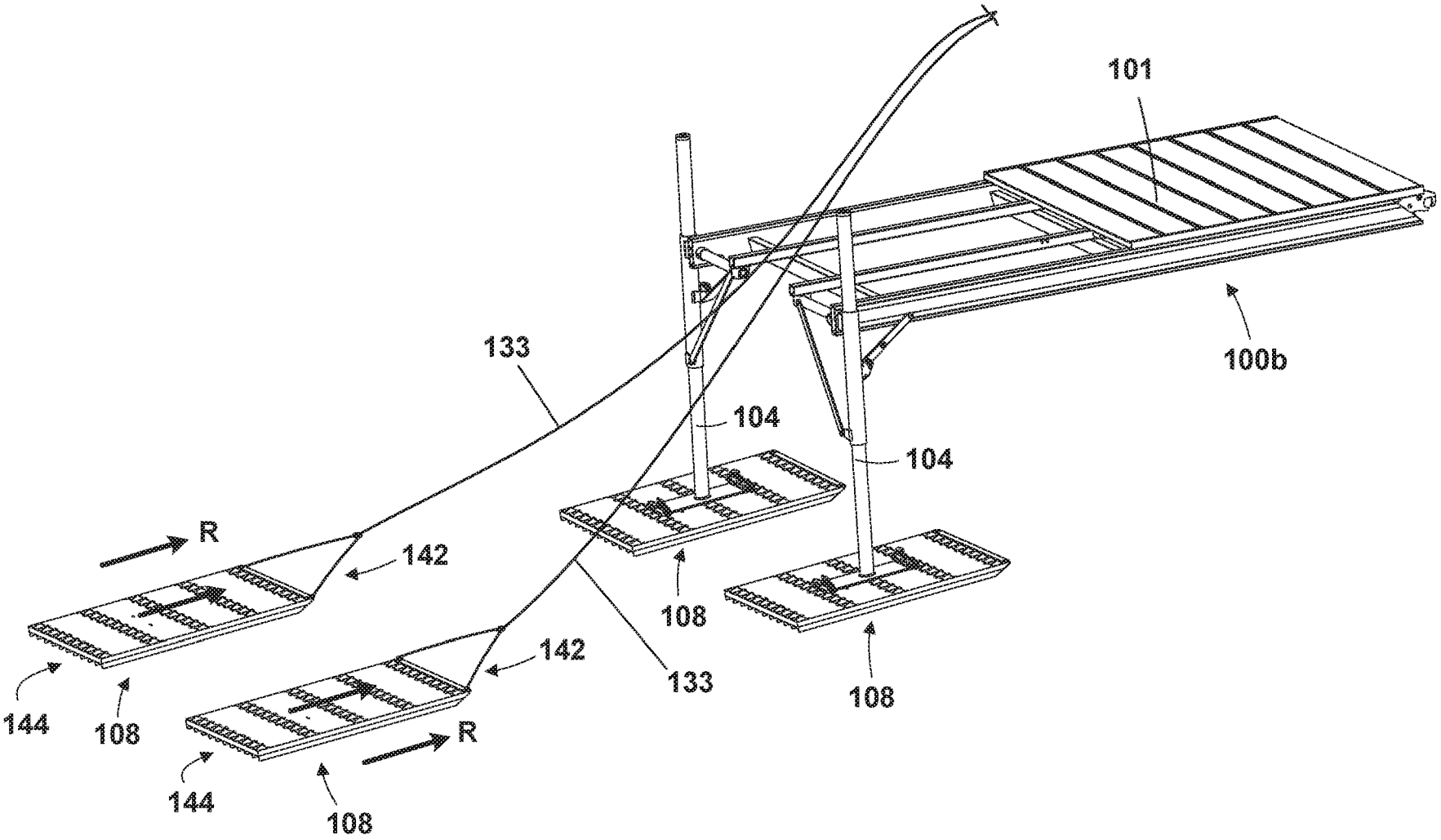
FIG. 26 illustrates a perspective view of an example removal step of removing the base pads from the underwater surface.

The removal devices 133 can then be used to remove the base pads 108 from the water 102. As shown in FIG. 26, because the removal devices 133 are attached to the removal features 134 of each base pad, the removal devices 133 can be pulled by a user on the platform 101 to remove the base pads 108. When the removal devices 133 are pulled, the base pads 108 are moved in the removal direction R to facilitate ease of removal from the underwater surface 106. As noted above with respect to FIGS. 8-10, the longitudinal and lateral ribs 138, 140 are configured in a way to facilitate the removal of the base pad 108 from the underwater surface 106 in the removal direction R. For example, the base pads 108 can easily be removed from underwater surfaces 106 comprised of mud (i.e., muck). This is facilitated by the ribs 138, 140 and removal features 134 reducing the force required to overcome suction created by the underwater surface 106.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A base pad for a pier support comprising:

a main body having a top side and a bottom side, the top side being configured to receive a pier support;

a plurality of ribs positioned on the bottom side of the main body, each rib having a length extending toward a front of the main body in a removal direction;

at least one aperture defined by the main body, the aperture passing through the top side to the bottom side of the main body, the aperture being configured to receive a fastener for securing the pier support to the top side of the main body; and lateral ribs positioned on the bottom side of the main body and between at least one of the plurality of ribs, the lateral ribs forming barbs to facilitate removal of the base pad from above a body of water in the removal direction and to reduce movement of the base pad in a direction opposite of the removal direction.

2. The base pad of claim 1, further comprising a plurality of apertures defined by the main body.

3. The base pad of claim 2, wherein at least one aperture is configured to receive a fastener for attaching a pier support.

4. The base pad of claim 2, wherein at least one aperture is configured to receive a removal device for removing the base pad from the body of water.

5. The base pad of claim 1, wherein the plurality of ribs includes a first set of ribs and a second set of ribs, wherein the first and second sets of ribs are generally transversely positioned to one another.

6. The base pad of claim 1, wherein the top side includes at least one flat section to receive at least a portion of the pier support.

7. The base pad of claim 1, wherein the main body includes the front and a rear, and wherein the rear includes at least one removal feature, wherein the removal feature is configured to receive a removal device so that the base pad can be removed from the body of water in the removal direction.

8. The base pad of claim 1, wherein the main body is configured to be submerged under water.

9. The base pad of claim 1, wherein the main body is water resistant.

10. A pier for use in a body of water, the pier comprising:

a main deck including a plurality of supports, each support having a foot, each foot including a top side and a bottom side; and a plurality of base pads removably attached to the bottom side of each foot by at least one fastener, each base pad having a surface area greater than a surface area of each foot, each base pad including:

a main body having a pad top side and a pad bottom side, the pad top side being configured to receive a pier support;

a plurality of ribs positioned on the pad bottom side of the main body, each rib having a length extending toward a front of the main body in a removal direction; and at least one aperture defined by the main body, the aperture passing through the pad top side to the pad bottom side of the main body, the aperture being configured to receive the at least one fastener; and lateral ribs positioned on the pad bottom side of the main body and between at least one of the plurality of ribs, the lateral ribs forming barbs to facilitate removal of the plurality of base pads from above the body of water in the removal direction and to reduce movement of the plurality of base pads in a direction opposite of the removal direction;

the at least one fastener being removable from each base pad from above the surface of the water when the pier is installed in a body of water, the at least one fastener including:

a fastener main body, wherein the fastener main body is configured to interface with the top side of each foot to pin each foot to each base pad;

an arm extending from the fastener main body, the arm being pivotable with respect to the fastener main body to couple and decouple the at least one fastener from each base pad.

11. The pier of claim 10, wherein the arm includes a removal feature for attaching a removal device thereto.

12. The pier of claim 10, wherein each base pad further comprises at least one removal feature, wherein the at least one removal feature is configured to receive a removal device to remove the base pad from the body of water in the removal direction.

13. A method of manipulating a pier comprising:

providing a main deck having a plurality of supports, each support having a foot, each foot including a top side and a bottom side;

attaching a base pad to at least one foot of the main deck with a quick-release fastener, the base pad including a plurality of ribs positioned on a bottom side of a main body, each rib having a length extending toward a front of the main body in a removal direction, the base pad further comprising lateral ribs positioned on the bottom side of the main body and between at least one of the plurality of ribs, the lateral ribs forming barbs to facilitate removal of the base pad from above a body of water in the removal direction and to reduce movement of the base pad in a direction opposite of the removal direction;

positioning the base pad in contact with an underwater surface; and removing the quick release fastener from above the water using a removal device.

14. The method of claim 13, further comprising removing the base pad from the underwater surface from a point above the water via a removal device in the removal direction.

15. The method of claim 13, wherein the quick release fastener includes:

a fastener main body, wherein the fastener main body is configured to interface with the top side of each foot to pin each foot to the base pad;

an arm extending from the fastener main body, the arm being pivotable with respect to the fastener main body to couple and decouple the fastener from the base pad.

* * * * *